US010242692B2

(12) United States Patent
Uhle et al.

(10) Patent No.: US 10,242,692 B2
(45) Date of Patent: Mar. 26, 2019

(54) AUDIO COHERENCE ENHANCEMENT BY CONTROLLING TIME VARIANT WEIGHTING FACTORS FOR DECORRELATED SIGNALS

(71) Applicant: Fraunhofer-Gesellschaft zur Förderung der angewandten Forschung e.V., München (DE)

(72) Inventors: Christian Uhle, Ursensollen (DE); Patrick Gampp, Erlangen (DE); Oliver Hellmuth, Budenhof (DE); Stefan Varga, Köln (DE); Sebastian Scharrer, Altdorf (DE)

(73) Assignee: Fraunhofer-Gesellschaft zur Förderung der angewandten Forschung e.V. (DE)

( * ) Notice: Subject to any disclaimer, the term of this patent is extended or adjusted under 35 U.S.C. 154(b) by 4 days.

(21) Appl. No.: 15/414,301

(22) Filed: Jan. 24, 2017

(65) Prior Publication Data

US 2017/0133034 A1 May 11, 2017

Related U.S. Application Data

(63) Continuation of application No. PCT/EP2015/067158, filed on Jul. 27, 2015.

(30) Foreign Application Priority Data

Jul. 30, 2014 (EP) ..... 14179181

(51) Int. Cl.
*G10L 19/008* (2013.01)
*G10L 21/0264* (2013.01)
(Continued)

(52) U.S. Cl.
CPC ..... *G10L 21/0308* (2013.01); *G10L 19/008* (2013.01); *G10L 19/0204* (2013.01); *G10L 19/025* (2013.01); *G10L 21/0264* (2013.01)

(58) Field of Classification Search
CPC ... G10L 19/008; G10L 19/26; G10L 21/0272; G10L 21/0308; G10L 25/06;
(Continued)

(56) References Cited

U.S. PATENT DOCUMENTS 6,175,631 B1 1/2001 Davis et al.
8,165,310 B2 * 4/2012 Christoph ..... H04M 3/56 381/112
(Continued)

FOREIGN PATENT DOCUMENTS

EP 2 541 542 * 2/2013 ..... G10K 15/12
EP 2688066 A1 1/2014
(Continued)

OTHER PUBLICATIONS

Endegard, et al. "AES Convention Paper 6074: Synthetic Ambience in Parametric Stereo Coding", May 8, 2004.
(Continued)

*Primary Examiner* — Martin Lerner
(74) *Attorney, Agent, or Firm* — Haynes and Boone, LLP

(57) ABSTRACT

An apparatus for enhancing an audio signal includes a signal processor for processing the audio signal in order to reduce or eliminate transient and tonal portions of the processed signal and a decorrelator for generating a first decorrelated signal and a second decorrelated signal from the processed signal. The apparatus further includes a combiner for weightedly combining the first and the second decorrelated signal and the audio signal or a signal derived from the audio signal by coherence enhancement using time variant weighting factors and to obtain a two-channel audio signal. The
(Continued)

apparatus further includes a controller for controlling the time variant weighting factors by analyzing the audio signal so that different portions of the audio signal are multiplied by different weighting factors and the two-channel audio signal has a time variant degree of decorrelation.

15 Claims, 16 Drawing Sheets

(51) Int. Cl.
*G10L 21/0308* (2013.01)
*G10L 19/02* (2013.01)
*G10L 19/025* (2013.01)

(58) Field of Classification Search
CPC ..... G10L 21/0264; H04S 7/30; H04S 7/307; H04S 2420/01
USPC ..... 704/205, 211, 216, 218, 500, 501; 381/17, 66, 10
See application file for complete search history.

(56) References Cited

U.S. PATENT DOCUMENTS

| | | | | |
|---|---|---|---|---|
| 8,351,611 | B2 | 1/2013 | Oh et al. | |
| 9,185,507 | B2 * | 11/2015 | Vinton | G10L 19/008 |
| 9,747,909 | B2 * | 8/2017 | Breebaart | G10L 19/008 |
| 2006/0210087 | A1 * | 9/2006 | Davis | H04R 5/04 381/17 |
| 2010/0094631 | A1 * | 4/2010 | Engdegard | G10L 19/008 704/258 |
| 2012/0057710 | A1 * | 3/2012 | Disch | H04S 7/30 381/22 |
| 2012/0063609 | A1 * | 3/2012 | Triki | H04M 9/082 381/66 |
| 2014/0185811 | A1 * | 7/2014 | Stein | H04S 7/307 381/17 |
| 2014/0222441 | A1 * | 8/2014 | Kuntz | G10L 19/008 704/500 |
| 2016/0232900 | A1 * | 8/2016 | Villemoes | G10L 19/008 |
| 2018/0184224 | A1 * | 6/2018 | McGrath | H04S 7/302 |

FOREIGN PATENT DOCUMENTS

| | | | |
|---|---|---|---|
| EP | 2704142 | A1 | 3/2014 |
| JP | 2008129189 | A | 6/2008 |
| JP | 2013134331 | A | 7/2013 |
| JP | 2013539554 | A | 10/2013 |
| JP | 2014-510474 | A | 4/2014 |
| RU | 2376656 | C2 | 12/2009 |
| RU | 2439719 | C2 | 1/2012 |
| WO | WO 01/05187 | A1 | 1/2001 |
| WO | WO 2008 049587 | A1 | 5/2008 |
| WO | WO 12/160472 | A1 | 11/2012 |

OTHER PUBLICATIONS

International Search Report and Written Opinion dated Nov. 9, 2015 for PCT/EP2015/067158.
Office Action issued in parallel Japan Patent Application No. 2017-505094 dated Jan. 30, 2018 (6 pages with English translation).
Office Action with search report issued in the parallel Russian patent application No. 2017106093 dated Mar. 22, 2018 (10 pages).
Office Action dated Aug. 22, 2018 issued in the parallel Korean patent application No. 10-2017-7000895 (12 pages with English translation).
ISO/IEC CD 23008-3: "Information technology—High efficiency coding and media delivery in heterogeneous environments—Part 3: 3D audio", ISO/IEC JTC 1/SC 29/WG11, Apr. 4, 2014 (283 pages).

* cited by examiner

| level of decorrelation | a | b |
|---|---|---|
| 10 | 9 | 2 |
| 9 | 8 | 2 |
| 8 | 7 | 2 |
| 7 | 6 | 2 |
| 6 | 5.4 | 3 |
| 5 | 4 | 3.8 |
| 4 | 3.5 | 4 |
| 3 | 3.5 | 5 |
| 2 | 2.8 | 6 |
| 1 | 2 | 7 |
| 0 | 1 | 8 |

FIGURE 3

| transient frequency band | spectral weight (217) |
|---|---|
| 15 | 0 |
| ... | ... |
| 5 | 0.3 |
| 4 | 0.7 |
| 3 | 0.8 |
| 2 | 0.85 |
| 1 | 1 |

FIGURE 7A

| transient frequency band | spectral weight (219) |
|---|---|
| 8 | 0.1 |
| ... | ... |
| 5 | 0.55 |
| 4 | 0.6 |
| 3 | 0.75 |
| 2 | 0.9 |
| 1 | 1 |

FIGURE 7B

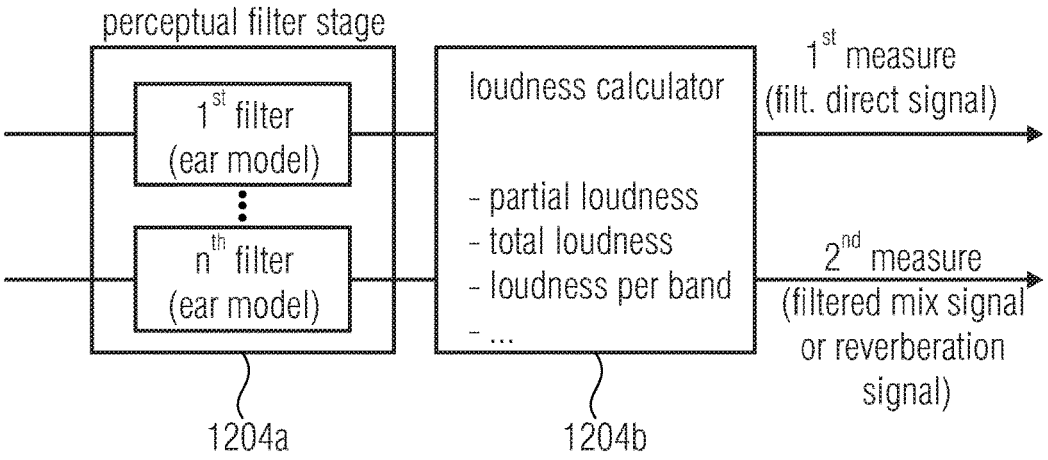
FIGURE 13A
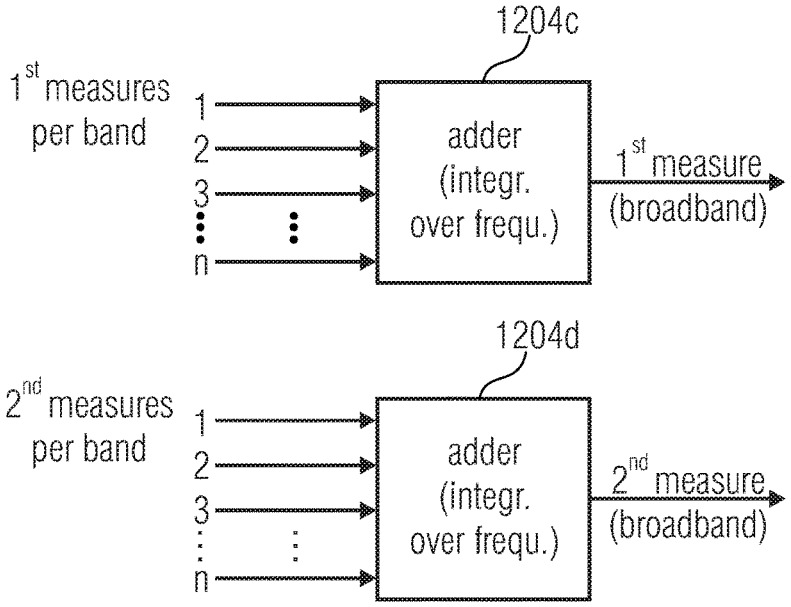
FIGURE 13B
| | model | $EST_1$ | $EST_2$ | measure |
|---|---|---|---|---|
| 1 | partial | r, x | x, r | $N_{r,x}-N_{x,r}$ |
| 2 | total | m | x | $N_m-N_x$ |
| 3 | total | r | m | $N_r-N_m$ |
| 4 | total | r | x | $N_r-N_x$ |
FIGURE 13C

AUDIO COHERENCE ENHANCEMENT BY CONTROLLING TIME VARIANT WEIGHTING FACTORS FOR DECORRELATED SIGNALS

CROSS-REFERENCE TO RELATED APPLICATIONS

This application is a continuation of co-pending International Application No. PCT/EP2015/067158, filed Jul. 27, 2015, which is incorporated herein by reference in its entirety, and additionally claims priority from European Application No. EP 14179181.4, filed Jul. 30, 2014, which is incorporated herein by reference in its entirety.

BACKGROUND OF THE INVENTION

The present application is related to audio signal processing and particularly to audio processing of a mono or dual-mono signal.

An auditory scene can be modeled as a mixture of direct and ambient sounds. Direct (or directional) sounds are emitted by sound sources, e.g. a musical instrument, a vocalist or a loudspeaker and arrive on the shortest possible path at the receiver, e.g. the listener's ear or a microphone. When capturing a direct sound using a set of spaced microphones, the received signals are coherent. In contrast, ambient (or diffuse) sounds are emitted by many spaced sound sources or sound reflecting boundaries that contribute to, for example, room reverberation, applause or a babble noise. When capturing an ambient sound field using a set of spaced microphones, the received signals are at least partially incoherent.

Monophonic sound reproduction can be considered appropriate in some reproduction scenarios (e.g. dance clubs) or for some types of signals (e.g. speech recordings), but the majority of musical recordings, movie sound and TV sound are stereophonic signals. Stereophonic signals can create the sensation of ambient (or diffuse) sounds and of the directions and widths of sound sources. This is achieved by means of stereophonic information that is encoded by spatial cues. The most important spatial cues are inter-channel level differences (ICLD), inter-channel time differences (ICTD) and inter-channel coherence (ICC). Consequently, stereophonic signals and the corresponding sound reproduction systems have more than one channel. ICLD and ICTD contribute to the sensation of a direction. ICC evokes the sensation of width of a sound and, in the case of ambient sounds, that a sound is perceived as coming from all directions.

Although multichannel sound reproduction in various formats exist, the majority of audio recordings and sound reproduction systems still have two channels. Two-channel stereophonic sound is the standard for entertainment systems, and the listeners are used to it. However, stereophonic signals are not restricted to have only two channel signals but can have more than one channel signal. Similarly, monophonic signals are not restricted to have only one channel signal, but can have multiple but identical channel signals. For example, an audio signal comprising two identical channel signals may be called a dual-mono signal.

There are various reasons why monophonic signals instead of stereophonic signals are available to the listener. First, old recordings are monophonic because stereophonic techniques were not used at that time. Secondly, restrictions of the bandwidth of a transmission or storage medium can lead to a loss of stereophonic information. A prominent example is radio broadcasting using frequency modulation (FM). Here, interfering sources, multipath distortions or other impairments of the transmission can lead to noisy stereophonic information, which is for the transmission of two-channel signals typically encoded as the difference signal between both channels. It is common practice to partially or completely discard the stereophonic information when the reception conditions are poor.

The loss of stereophonic information may lead to a reduction of sound quality. In general, an audio signal comprising a higher number of channels may comprise a higher sound quality when compared to an audio signal comprising a lower number of channels. Listeners may listen to audio signals comprising a high sound quality. For efficiency reasons such as data rates transmitted over or stored in media sound quality is often reduced.

Therefore, there exists a need for increasing (enhancing) sound quality of audio signals.

SUMMARY

According to an embodiment, an apparatus for enhancing an audio signal may have: a signal processor for processing the audio signal in order to reduce or eliminate transient and tonal portions of the processed signal; a decorrelator for generating a first decorrelated signal and a second decorrelated signal from the processed signal; a combiner for weightedly combining the first decorrelated signal, the second decorrelated signal and the audio signal or a signal derived from the audio signal by coherence enhancement using time variant weighting factors and to obtain a two-channel audio signal; and a controller for controlling the time variant weighting factors by analyzing the audio signal so that different portions of the audio signal are multiplied by different weighting factors and the two-channel audio signal has a time variant degree of decorrelation.

According to an embodiment, a sound enhancing system may have an inventive apparatus for enhancing an audio signal; a signal input configured to receive the audio signal; at least two loudspeakers configured to receive the two-channel audio signal or a signal derived from the two-channel audio signal and to generate acoustic signals from the two-channel audio signal or the signal derived from the two-channel audio signal.

According to an embodiment, a method for enhancing an audio signal may have the steps of: processing the audio signal in order to reduce or eliminate transient and tonal portions of the processed signal; generating a first decorrelated signal and a second decorrelated signal from the processed signal; weightedly combining the first decorrelated signal, the second decorrelated signal and the audio signal or a signal derived from the audio signal by coherence enhancement using time variant weighting factors and to obtain a two-channel audio signal; and controlling the time variant weighting factors by analyzing the audio signal so that different portions of the audio signal are multiplied by different weighting factors and the two-channel audio signal has a time variant degree of decorrelation.

An embodiment may have a non-transitory digital storage medium having a computer program stored thereon to perform the method of for enhancing an audio signal, having the steps of: processing the audio signal in order to reduce or eliminate transient and tonal portions of the processed signal; generating a first decorrelated signal and a second decorrelated signal from the processed signal; weightedly combining the first decorrelated signal, the second decorrelated signal and the audio signal or a signal derived from the audio signal by coherence enhancement using time variant weighting factors and to obtain a two-channel audio signal; and controlling the time variant weighting factors by analyzing the audio signal so that different portions of the audio signal are multiplied by different weighting factors and the two-channel audio signal has a time variant degree of decorrelation, when said computer program is run by a computer.

The present invention is based on the finding that a received audio signal may be enhanced by artificially generating spatial cues by splitting the received audio signals into at least two shares and by decorrelating at least one of the shares of the received signal. A weighted combination of the shares allows for receiving an audio signal perceived as stereophonic and is therefore enhanced. Controlling the applied weights allows for a variant degree of decorrelation and therefore a variant degree of enhancement such that a level of enhancement may be low when the decorrelation may lead to annoying effects that reduce sound quality. Thus, a variant audio signal may be enhanced comprising portions or time intervals where low or no decorrelation is applied such as for speech signals and comprising portions or time intervals where more or a high degree of decorrelation is applied such as for music signals.

An embodiment of the present invention provides an apparatus for enhancing an audio signal. The apparatus comprises a signal processor for processing the audio signal in order to reduce or eliminate transient and tonal portions of the processed signal. The apparatus further comprises a decorrelator for generating a first decorrelated signal and a second decorrelated signal from the processed signal. The apparatus further comprises a combiner and a controller. The combiner is configured for weightedly combining the first decorrelated signal, the second decorrelated signal and the audio signal or a signal derived from the audio signal by coherence enhancement using time variant weighting factors and to obtain a two-channel audio signal. The controller is configured to control the time variant weighting factors by analyzing the audio signal so that different portions of the audio signal are multiplied by different weighting factors and the two-channel audio signal has a time variant degree of decorrelation.

The audio signal having little or no stereophonic (or multichannel) information, e.g., a signal having one channel or a signal having multiple but almost identical channel signals, may be perceived as a multichannel, e.g., a stereophonic signal, after the enhancement has been applied. A received mono or dual-mono audio signal may be processed differently in different paths, wherein in one path transient and/or tonal portions of the audio signal are reduced or eliminated. A signal processed in such a way being decorrelated and the decorrelated signal being weightedly combined with the second path comprising the audio signal or a signal derived thereof allows for obtaining two signal channels that may comprise a high decorrelation factor with respect to each other such that the two channels are perceived as a stereophonic signal.

By controlling the weighting factors used for weightedly combining the decorrelated signal and the audio signal (or the signal derived thereof) a time variant degree of decorrelation may be obtained such that in situations, in which enhancing the audio signal would possibly lead to unwanted effects, enhancing may be reduced or skipped. For example, a signal of a radio speaker or other prominent sound source signals are unwanted to be enhanced as perceiving a speaker from multiple locations of sources might lead to annoying effects to a listener.

According to a further embodiment, an apparatus for enhancing an audio signal comprises a signal processor for processing the audio signal in order to reduce or eliminate transient and tonal portions of the processed signal. The apparatus further comprises a decorrelator, a combiner and a controller. The decorrelator is configured to generate a first decorrelated signal and a second decorrelated signal from the processed signal. The combiner is configured to weightedly combine the first decorrelated signal and the audio signal or a signal derived from the audio signal by coherence enhancement using time variant weighting factors and to obtain a two-channel audio signal. The controller is configured to control the time variant weighting factors by analyzing the audio signal so that different portions of the audio signal are multiplied by different weighting factors and the two-channel audio signal has a time variant degree of decorrelation. This allows for perceiving a mono signal or a signal similar to a mono signal (such as dual-mono or multi-mono) as being a stereo-channel audio signal.

For processing the audio signal, the controller and/or the signal processor may be configured to process a representation of the audio signal in the frequency domain. The representation may comprise a plurality or a multitude of frequency bands (subbands), each comprising a part, i.e., a portion of the audio signal of the spectrum of the audio signal respectively. For each of the frequency bands, the controller may be configured to predict a perceived level of decorrelation in the two-channel audio signal. The controller may further be configured to increase the weighting factors for portions (frequency bands) of the audio signal allowing a higher degree of decorrelation and to decrease the weighting factors for portions of the audio signal allowing a lower degree of decorrelation. For example, a portion comprising a non-prominent sound source signal such as applause or bubble noise may be combined by a weighting factor that allows for a higher decorrelation than a portion that comprises a prominent sound source signal, wherein the term prominent sound source signal is used for portions of the signal that are perceived as direct sounds, for example speech, a musical instrument, a vocalist or a loudspeaker.

The processor may be configured to determine for each of some or all of the frequency band, if the frequency band comprises transient or tonal components and to determine spectral weightings that allow for a reduction of the transient or tonal portions. The spectral weights and the scaling factors may each comprise a multitude of possible values such that annoying effects due to binary decisions may be reduced and/or avoided.

The controller may further be configured to scale the weighting factors such that a perceived level of decorrelation in the two-channel audio signal remains within a range around a target value. The range may extend, for example to ±20%, +10% or ±5% of the target value. The target value may be, for example, a previously determined value for a measure of the tonal and/or transient portion such that, for example, the audio signal comprising varying transient and tonal portions varying target value are obtained. This allows for perform a low or even none decorrelation when the audio signal is decorrelated or no decorrelation is aimed such as for prominent sound source signals like speech and for a high decorrelation if the signal is not decorrelated and/or decorrelation is aimed. The weighting factors and/or the spectral weights may be determined and/or adjusted to multiple values or even almost continuously.

The decorrelator may be configured to generate the first decorrelated signal based on a reverberation or a delay of the audio signal. The controller may be configured to generate the test decorrelated signal also based on a reverberation or a delay of the audio signal. A reverberation may be performed by delaying the audio signal and by combining the audio signal and the delayed version thereof similar to an finite impulse response filter structure, wherein the reverberation may also be implemented as an infinite impulse response filter. A delay time and/or a number of delays and combinations may vary. A delay time delaying or reverberating the audio signal for the test decorrelated signal may be shorter than a delay time, for example, resulting in less filter coefficients of the delay filter, for delaying or reverberating the audio signal for the first decorrelated signal. For predicting the perceived intensity of decorrelation, a lower degree of decorrelation and thus a shorter delay time may be sufficient such that by reducing the delay time and/or the filter coefficients a computational effort and/or a computational power may be reduced.

BRIEF DESCRIPTION OF THE DRAWINGS

Embodiments of the present invention will be detailed subsequently referring to the appended drawings, in which:

FIG. 3 shows an exemplary table indicating a computing of the scaling factors (weighting factors) based on the level of the predicted perceived intensity of decorrelation;

FIG. 7*a* shows a schematic table illustrating a possible transient processing performed by a transient processing stage;

FIG. 7*b* shows an exemplary table that illustrates a possible tonal processing as it may be executed by a tonal processing stage.

FIG. 13*a-c* show implementations of a loudness model processor; and

DETAILED DESCRIPTION OF THE INVENTION

Figure 1:
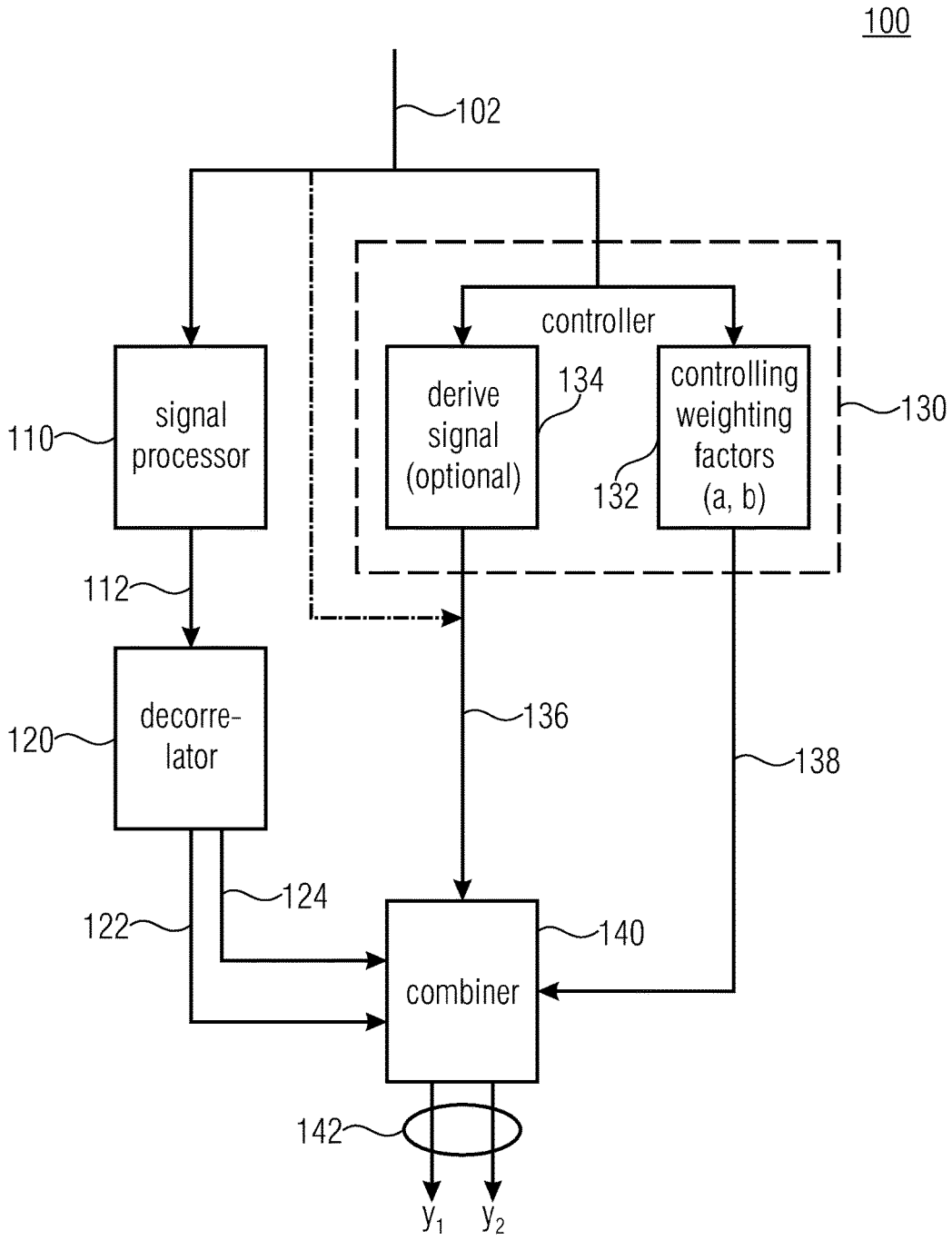
FIG. 1 shows a schematic block diagram of an apparatus for enhancing an audio signal.

Equal or equivalent elements or elements with equal or equivalent functionality are denoted in the following description by equal or equivalent reference numerals even if occurring in different figures.

In the following description, a plurality of details is set forth to provide a more thorough explanation of embodiments of the present invention. However, it will be apparent to those skilled in the art that embodiments of the present invention may be practiced without these specific details. In other instances, well known structures and devices are shown in block diagram form rather than in detail in order to avoid obscuring embodiments of the present invention. In addition, features of the different embodiments described hereinafter may be combined with each other, unless specifically noted otherwise.

In the following, reference will be made to process an audio signal. An apparatus or a component thereof may be configured to receive, provide and/or process an audio signal. The respective audio signal may be received, provided or processed in the time domain and/or the frequency domain. An audio signal representation in the time domain may be transformed into a frequency representation of the audio signal for example by Fourier transformations or the like. The frequency representation may be obtained, for example, by using a Short-Time Fourier transform (STFT), a discrete cosine transform and/or a Fast Fourier transform (FFT). Alternatively or in addition, the frequency representation may be obtained by a filterbank which may comprise Quadrature Mirror Filters (QMF). A frequency domain representation of the audio signal may comprise a plurality of frames each comprising a plurality of subbands as it is known from Fourier transformations. Each subband comprises a portion of the audio signal. As the time representation and the frequency representation of the audio signal may be converted one into the other, the following description shall not be limited to the audio signal being the time domain representation or the frequency domain representation.

FIG. 1 shows a schematic block diagram of an apparatus 10 for enhancing an audio signal 102. The audio signal 102 is, for example, a mono signal or a mono-like signal, such as a dual-mono signal, represented in the frequency domain or the time domain. The apparatus 100 comprises a signal processor 110, a decorrelator 120, a controller 130 and a combiner 140. The signal processor 110 is configured for receiving the audio signal 102 and for processing the audio signal 102 to obtain a processed signal 112 in order to reduce or eliminate transient and tonal portions of the processed signal 112 when compared to the audio signal 102.

The decorrelator 120 is configured for receiving the processed signal 112 and for generating a first decorrelated signal 122 and a second decorrelated signal 124 from the processed signal 112. The decorrelator 120 may be configured for generating the first decorrelated signal 122 and the second decorrelated signal 124 at least partially by reverberating the processed signal 112. The first decorrelated signal 122 and the second decorrelated signal 124 may comprise different time delays for the reverberation such that the first decorrelated signal 122 comprises a shorter or longer time delay (reverberation time) than the second decorrelated signal 124. The first or second decorrelated signal 122 or 124 may also be processed without a delay or reverberation filter.

The decorrelator 120 is configured to provide the first decorrelated signal 122 and the second decorrelated signal 124 to the combiner 140. The controller 130 is configured to receive the audio signal 102 and to control time variant weighting factors a and b by analyzing the audio signal 102 so that different portions of the audio signal 102 are multiplied by different weighting factors a or b. Therefore, the controller 130 comprises a controlling unit 132 configured to determine the weighting factors a and b. The controller 130 may be configured to operate in the frequency domain. The controlling unit 132 may be configured to transform the audio signal 102 into the frequency domain by using a Short-Time Fourier transform (STFT), a Fast Fourier transform (FFT) and/or a regular Fourier transform (FT). A frequency domain representation of the audio signal 102 may comprise a plurality of subbands as it is known from Fourier transformations. Each subband comprises a portion of the audio signal. Alternatively, the audio signal 102 may be a representation of a signal in the frequency domain. The controlling unit 132 may be configured to control and/or to determine a pair of weighting factors a and b for each subband of the digital representation of the audio signal.

The combiner is configured for weightedly combining the first decorrelated signal 122, the second decorrelated signal 124, a signal 136 derived from the audio signal 102 using the weighting factors a and b. The signal 136 derived from the audio signal 102 may be provided by the controller 130. Therefore, the controller 130 may comprise an optional deriving unit 134. The deriving unit 134 may be configured, for example, to adapt, modify or enhance portions of the audio signal 102. Particularly, the deriving unit 134 may be configured to amplify portions of the audio signal 102 that are attenuated, reduced or eliminated by the signal processor 110.

The signal processor 110 may be configured to also operate in the frequency domain and to process the audio signal 102 such that the signal processor 110 reduces or eliminates transient and tonal portions for each subband of a spectrum of the audio signal 102. This may lead to less or even no processing for subbands comprising little or non-transient or little or non-tonal (i.e. noisy) portions. Alternatively, the combiner 140 may receive the audio signal 102 instead of the derived signal, i.e., the controller 130 can be implemented without the deriving unit 134. Then, the signal 136 may be equal to the audio signal 102.

Then combiner 140 is configured to receive a weighting signal 138 comprising the weighting factors a and b. The combiner 140 is further configured to obtain an output audio signal 142 comprising a first channel $y_1$ and a second channel $y_2$, i.e., the audio signal 142 is a two-channeled audio signal.

The signal processor 110, the decorrelator 120, the controller 130 and the combiner 140 may be configured to process the audio signal 102, the signal 136 derived thereof and/or processed signals 112, 122 and/or 124 frame-wise and subband-wise such that the signal processor 110, the decorrelator 120, the controller 130 and the combiner 140 may be configured to execute above described operations to each frequency band by processing one or more frequency bands (portions of the signal) at a time.

Figure 2:
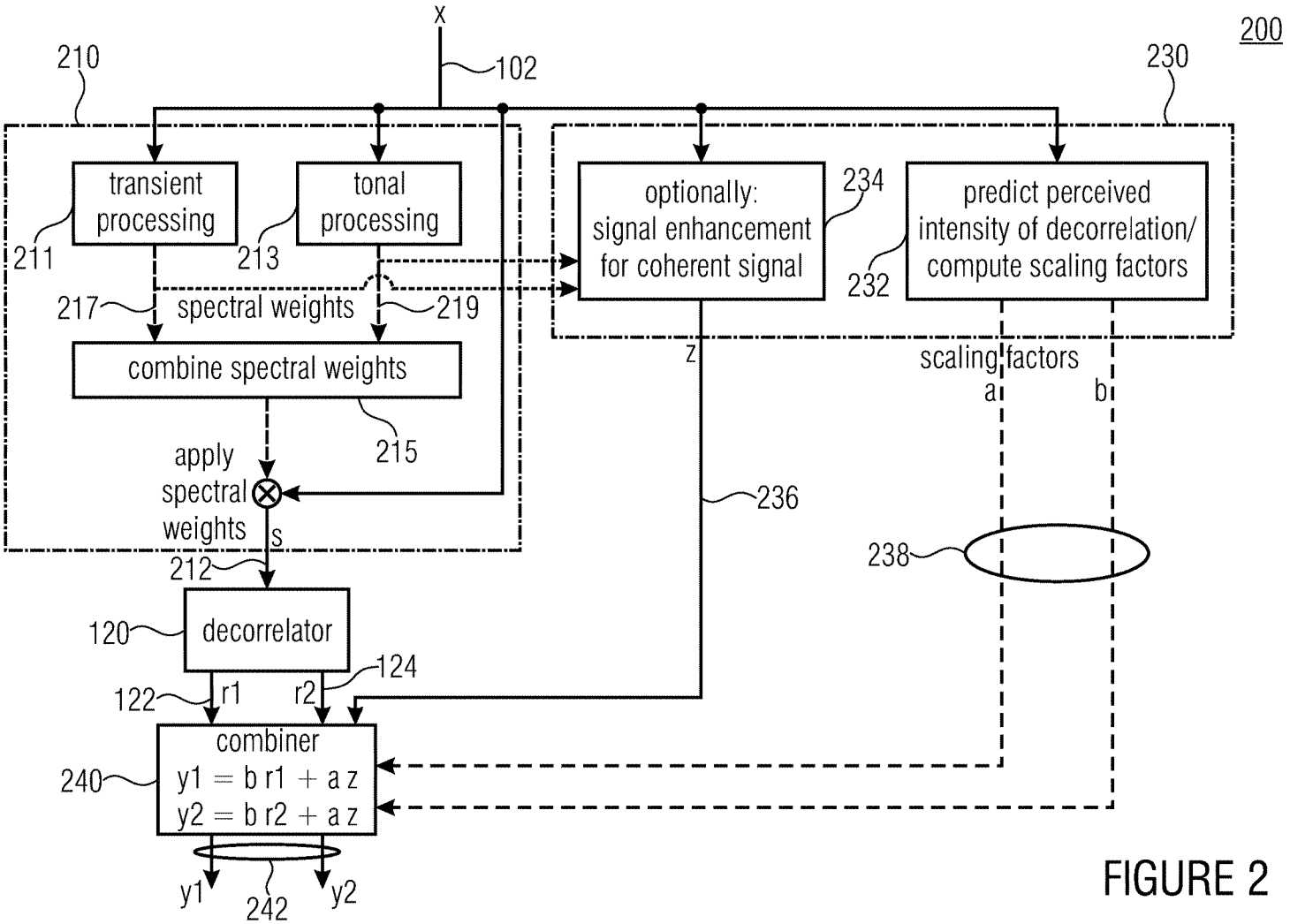
FIG. 2 shows a schematic block diagram of a further apparatus for enhancing the audio signal.

FIG. 2 shows a schematic block diagram of an apparatus 200 for enhancing the audio signal 102. The apparatus 200 comprises a signal processor 210, the decorrelator 120, a controller 230 and a combiner 240. The decorrelator 120 is configured to generate the first decorrelated signal 122 indicated as r1 and the second decorrelated signal 124, indicated as r2.

The signal processor 210 comprises a transient processing stage 211, a tonal processing stage 213 and a combining stage 215. The signal processor 210 is configured to process a representation of the audio signal 102 in the frequency domain. The frequency domain representation of the audio signal 102 comprises a multitude of subbands (frequency bands), wherein the transient processing stage 211 and the tonal processing stage 213 are configured to process each of the frequency bands. Alternatively, the spectrum obtained by frequency conversion of the audio signal 102 may be reduced, i.e., cut, to exclude certain frequency ranges or frequency bands from further processing, such as frequency bands below 20 Hz, 50 Hz or 100 Hz and/or above 16 kHz, 18 kHz or 22 kHz. This may allow for a reduced computational effort and thus for faster and/or a more precise processing.

The transient processing stage 211 is configured to determine for each of the processed frequency bands, if the frequency band comprises transient portions. The tonal processing stage 213 is configured to determine for each of the frequency bands, if the audio signal 102 comprises tonal portions in the frequency band. The transient processing stage 211 is configured to determine at least for the frequency bands comprising transient portions spectral weighting factors 217, wherein the spectral weighting factors 217 are associated with the respective frequency band. As it will be described in FIGS. 6*a* and 6*b*, transient and tonal characteristics may be identified by spectral processing. A level of transiency and/or tonality may be measured by the transient processing stage 211 and/or the tonal processing stage 213 and converted to a spectral weight. The tonal processing stage 213 is configured to determine spectral weighting factors 219 at least for frequency bands comprising the tonal portions. The spectral weighting factors 217 and 219 may comprise a multitude of possible values, the magnitude of the spectral weighting factors 217 and/or 219 indicating an amount of transient and/or tonal portions in the frequency band.

The spectral weighting factors 217 and 219 may comprise an absolute or relative value. For example, the absolute value may comprise a value of energy of transient and/or tonal sound in the frequency band. Alternatively, the spectral weighting factors 217 and/or 219 may comprise the relative value such as a value between 0 and 1, the value 0 indicating that the frequency band comprises no or almost no transient or tonal portions and the value 1 indicating the frequency band comprising a high amount or completely transient and/or tonal portions. The spectral weighting factors may comprise one of a multitude of values such as a number of 3, 5, 10 or more values (steps), e.g., (0, 0.3 and 1), (0.1, 0.2, . . . , 1) or the like. A size of the scale, a number of steps between a minimum value and a maximum value may be at least zero but advantageously at least one and more advantageously at least five. Advantageously, the multitude of values of the spectral weights 217 and 219 comprises at least three values comprising a minimum value, a maximum value and a value that is between the minimum value and the maximum value. A higher number of values between the minimum value and the maximum value may allow for a more continuous weighting of each of the frequency bands. The minimum value and the maximum value may be scaled to a scale between 0 and 1 or other values. The maximum value may indicate a highest or lowest level of transiency and/or tonality.

The combining stage 215 is configured to combine the spectral weights for each of the frequency bands as it is described later on. The signal processor 210 is configured to apply the combined spectral weights to each of the frequency bands. For example the spectral weights 217 and/or 219 or a value derived thereof may be multiplied with spectral values of the audio signal 102 in the processed frequency band.

The controller 230 is configured to receive the spectral weighting factors 217 and 219 or information referring thereto from the signal processor 210. The information derived may be, for example, an index number of a table, the index number being associated to the spectral weighting factors. The controller is configured to enhance the audio signal 102 for coherent signal portions, i.e., for portions not or only partially reduced or eliminated by the transient processing stage 211 and/or the tonal processing stage 213. In simple terms, the deriving unit 234 may amplify portions not reduced or eliminated by the signal processor 210. Unit 232 is configured to predict the perceived intensity of decorrelation and compute scaling factors and output scaling factors a and b.

The deriving unit 234 is configured to provide a signal 236 derived from the audio signal 102, indicated as z. The combiner 240 is configured to receive the signal z (236). The decorrelator 120 is configured to receive a processed signal 212 indicated as s from the signal processor 210.

The combiner 240 is configured to combine the decorrelated signals r1 and r2 with the weighting factors (scaling factors) a and b, to obtain a first channel signal y1 and a second channel signal y2. The signal channels y1 and y2 may be combined to the output signal 242 or be outputted separately.

In other words, the output signal 242 is a combination of a (typically) correlated signal z (236) and a decorrelated signal s (r1 or r2, respectively). The decorrelated signal as is obtained in two steps, first suppressing (reducing or eliminating) transient and tonal signal components and second decorrelation. The suppression of transient signal components and of tonal signal components is done by means of spectral weighting. The signal is processed frame-wise in the frequency domain. Spectral weights are computed for each frequency bin (frequency band) and time frame. Thus the audio signal is processed full-band, i.e. all portions that are to be considered are processed.

The input signal of the processing may be a single-channel signal x (102), the output signal may be a two-channel signal y=[y1,y2], where indices denote the first and the second channel, for example, the left and the right channel of a stereo signal. The output signal y may be computed by linearly combining a two-channel signal r=[r1, r2], with a single-channel signal z with scaling factors a and b according to $$y1=a\times z+b\times r1 \quad (1)$$

$$y2=a\times z+b\times r2 \quad (2)$$

wherein "x" refers to the multiplication operator in equations (1) and (2).

The equations (1) and (2) shall be interpreted qualitatively, indicating that a share of the signals z. r1 and r2 may be controlled (varied) by varying weighting factors. By forming, for example, inverse operations such as dividing by the reciprocal value same or equivalent results may be obtained by performing different operations. Alternatively or in addition, a look-up table comprising the scaling factors a and b and/or values for y1 and/or y2 may be used to obtain the two-channel signal y.

The scaling factors a and/or b may be computed to be monotonically decreasing with the perceived intensity of the correlation. The predicted scalar value for the perceived intensity may be used for controlling the scaling factors.

The decorrelated signal r comprising r1 and r2 may be computed in two steps. First, attenuation of transient and tonal signal components yielding the signal s. Second, decorrelation of the signal s may be performed.

The attenuation of transient signal components and of tonal signal components is done, for example, by means of a spectral weighting. The signal is processed frame-wise in the frequency domain. Spectral weights are computed for each frequency bin and time frame. An aim of the attenuation is two-fold:

1. Transient or tonal signal components typically belong to so-called foreground signals and as such their position within the stereo image is often in the center.
2. Decorrelation of signals having strong transient signal components lead to perceivable artifacts. Decorrelation of signals having strong tonal signal components also leads to perceivable artifacts when the tonal components (i.e. sinusoidals) are frequency modulated at least when the frequency modulation is slow enough to be perceived as a change of the frequency and not as change of timbre due to the enrichment of the signal spectrum (possibly inharmonic) overtones.

The correlated signal z may be obtained by applying a processing that enhances transient and tonal signal components, for example, qualitatively the inverse of the suppression for computing the signal s. Alternatively, the input signal, for example, unprocessed, can be used as it is. Note that there can be the case where z is also a two-channel signal. In fact, many storage media (e.g. the Compact Disc) use two channels even if the signal is mono. A signal having two identical channels is called "dual-mono". There can also be the case where the input signal z is a stereo signal, and the aim of the processing may be to increase the stereophonic effect.

The perceived intensity of decorrelation may be predicted similar to a predicted perceived intensity of late reverberation using computational models of loudness, as it is described in EP 2 541 542 A1.

FIG. 3 shows an exemplary table indicating a computing of the scaling factors (weighting factors) a and b based on the level of the predicted perceived intensity of decorrelation.

For example, the perceived intensity of decorrelation may be predicted such that a value thereof comprises a scalar value that may vary between a value of 0, indicating a low level of perceived decorrelation, none respectively and a value of 10, indicating a high level of decorrelation. The levels may be determined, for example, based on listeners tests or predictive simulation. Alternatively, the value of level of decorrelation may comprise a range between a minimum value and a maximum value. The value of the perceived level of decorrelation may be configured to accept more than the minimum and the maximum value. Advantageously, the perceived level of the correlation may accept at least three different values and more advantageously at least seven different values.

Weighting factors a and b to be applied based on a determined level of perceived decorrelation may be stored in a memory and accessible to the controller 130 or 230. With increasing levels of perceived decorrelation the scaling factor a to be multiplied with the audio signal or the signal derived thereof by the combiner may also increase. An increased level of perceived decorrelation may be interpreted as "the signal is already (partially) decorrelated" such that with increasing levels of decorrelation the audio signal or the signal derived thereof comprises a higher share in the output signal 142 or 242. With increased levels of decorrelation, the weighting factor b is configured to be decreased, i.e., the signals r1 and r2 generated by the decorrelator based on an output signal of the signal processor may comprise a lower share when being combined in the combiner 140 or 240.

Although the weighting factor a is depicted as comprising a scalar value of at least 1 (minimum value) and at most 9 (maximum value) and the weighting factor b is depicted as comprising a scalar value in a range comprising a minimum value of 2 and a maximum value of 8, both weighting factors a and b may comprise a value within a range comprising a minimum value and a maximum value and advantageously at least one value between the minimum value and the maximum value. Alternatively to the values of the weighting factors a and b depicted in FIG. 3 and with an increased level of perceived decorrelation, the weighting factor a may increase linearly. Alternatively or in addition, the weighting factor b may decrease linearly with an increased level of perceived decorrelation. In addition, for a level of perceived decorrelation, a sum of the weighting factors a and b determined for a frame may be constant or almost constant. For example, the weighting factor a may increase from 0 to 10 and the weighting factor b may decrease from a value of 10 to a value of 0 with an increasing level of perceived decorrelation. If both weighting factors decrease or increase linearly, for example with step size 1, the sum of the weighting factors a and b may comprise a value of 10 for each level of perceived decorrelation. The weighting factors a and b to be applied may be determined by simulation or by experiment.

Figure 4B:
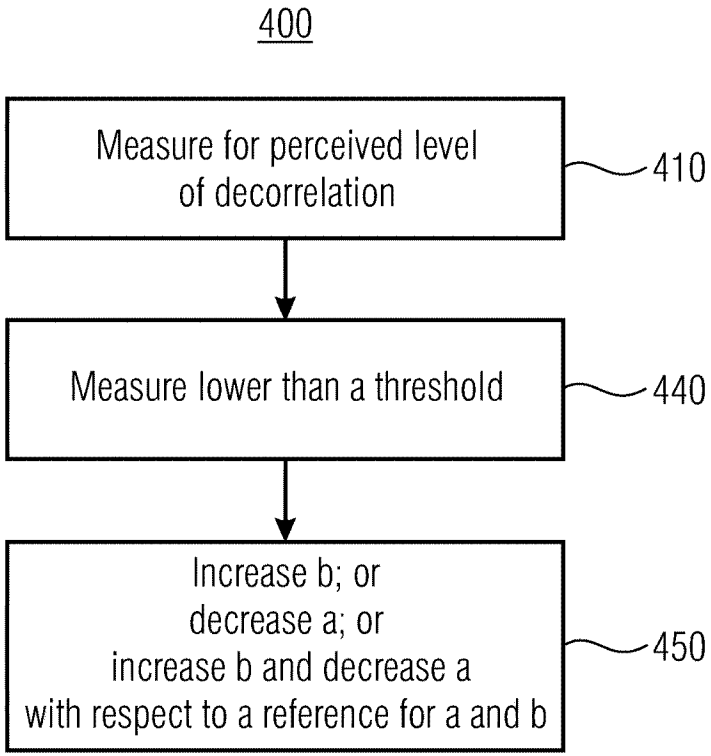
FIG. 4*b* shows a schematic flowchart of further steps of the method of FIG. 4*a*, depicting a case, where the measure for the perceived level of decorrelation is compared to the threshold values.
Figure 4A:
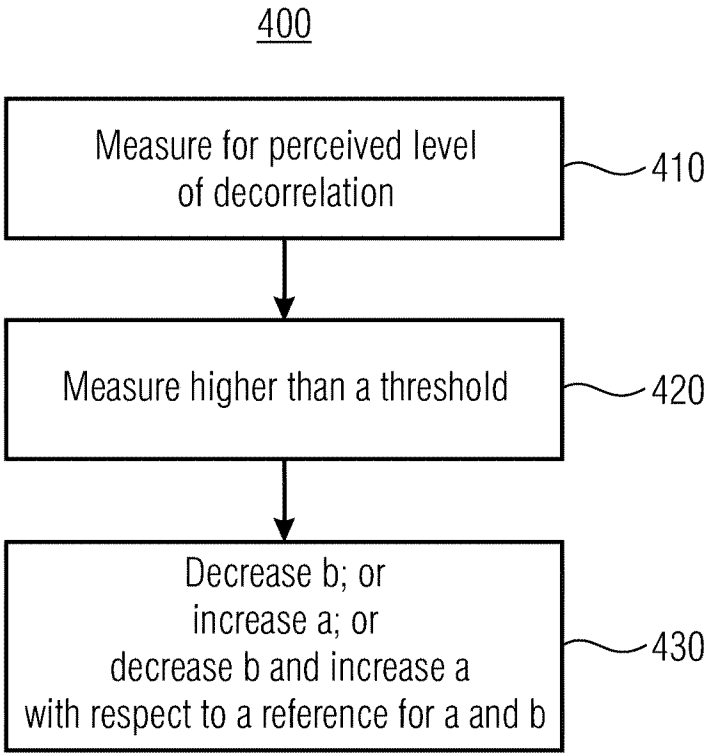
FIG. 4*a* shows a schematic flowchart of a part of a method that may be executed, for partially determining weighting factors.

FIG. 4*a* shows a schematic flowchart of a part of a method 400 that may be executed, for example, by the controller 130 and/or 230. The controller is configured to determine a measure for the perceived level of a decorrelation in a step 410 yielding, for example, in a scalar value as it is depicted in FIG. 3. In a step 420, the controller is configured to compare the determined measure with a threshold value. If the measure is higher than the threshold value, the controller is configured to modify or adapt the weighting factors a and/or b in a step 430. In the step 430, the controller is configured to decrease the weighting factor b, to increase the weighting factor a or to decrease the weighting factor b and to increase the weighting factor a with respect to a reference value for a and b. The threshold may vary, for example, within frequency bands of the audio signal. For example, the threshold may comprise a low value for frequency bands comprising a prominent sound source signal indicating that a low level of decorrelation is advantageous or aimed. Alternatively or in addition, the threshold may comprise a high value for frequency bands comprising a non-prominent sound source signal indicating that a high level of decorrelation is advantageous.

It may be an aim to increase the correlation of frequency bands comprising non-prominent sound source signals and to limit decorrelation for frequency bands comprising prominent sound source-signals. A threshold may be, for example, 20%, 50% or 70% of a range of values the weighting factors a and/or b may accept. For example, and with reference to FIG. 3, the threshold value may be lower than 7, lower than 5 or lower than 3 for a frequency frame comprising a prominent sound source signal. If the perceived level of decorrelation is too high, then, by executing step 430, the perceived level of decorrelation may be decreased. The weighting factors a and b may be varied solely or both at a time. The table depicted in FIG. 3 may be, for example, a value comprising initial values for the weighting factors a and/or b, the initial values to be adapted by the controller.

FIG. 4*b* shows a schematic flowchart of further steps of the method 400, depicting a case, where the measure for the perceived level of decorrelation (determined in step 410) is compared to the threshold values, wherein the measure is lower than the threshold value (step 440). The controller is configured to increase b, to decrease a or to increase b and to decrease a with respect to a reference for a and b to increase the perceived level of decorrelation and such that the measure comprises a value that is at least the threshold value.

Alternatively or in addition, the controller may be configured to scale the weighting factors a and b such that a perceived level of decorrelation in the two-channel audio signal remains within a range around a target value. The target value may be, for example, the threshold value, wherein the threshold value may vary based on the type of signal being comprised by the frequency band for which the weighting factors and/or the spectral weights are determined. The range around the target value may extend to +20%, +10%, or ±5% of the target value. This may allow to stop adapting the weighting factors when the perceived decorrelation is approximately the target value (threshold).

Figure 5:
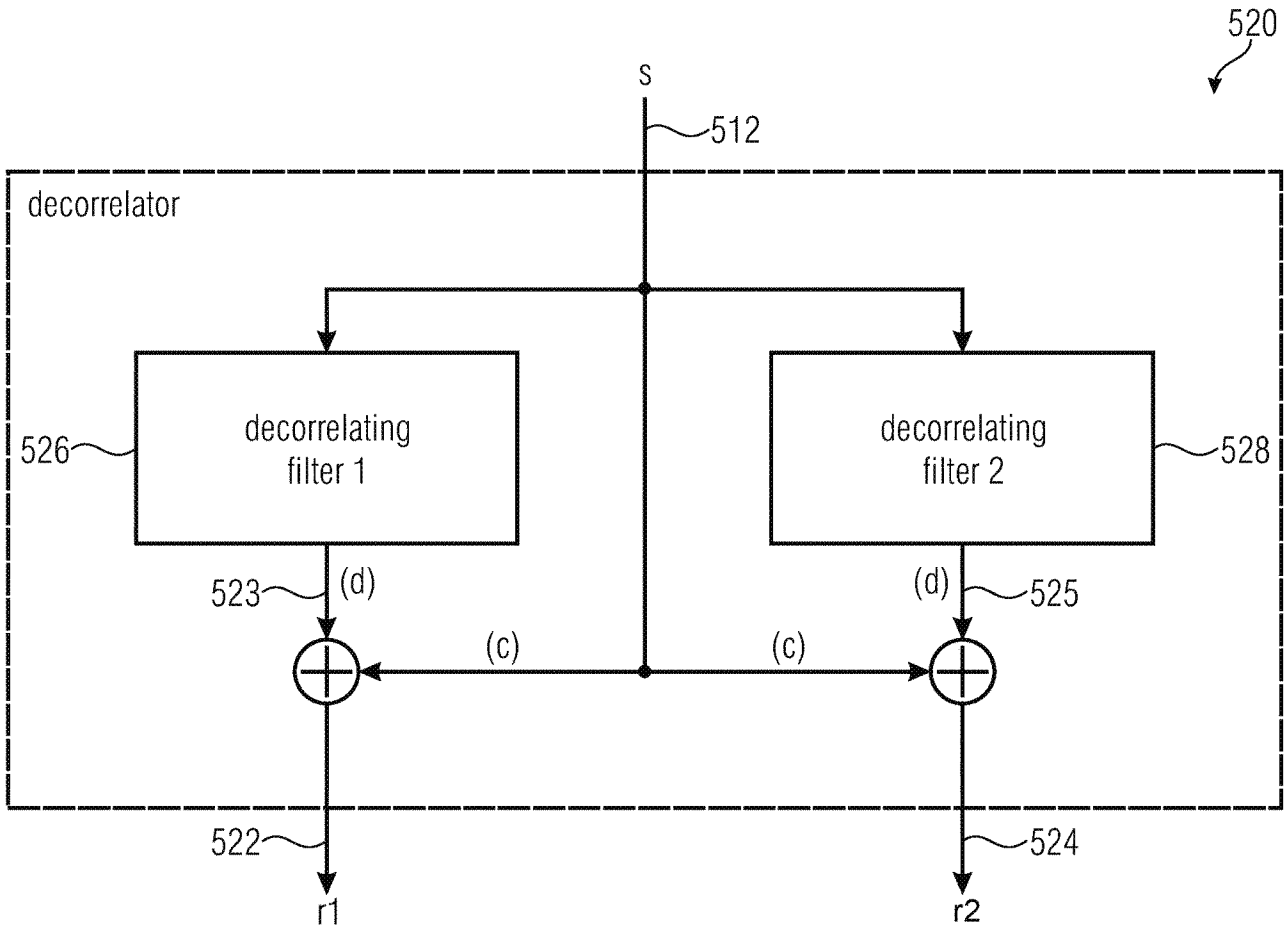
FIG. 5 shows a schematic block diagram of a decorrelator that may be configured to operate as the decorrelator in FIG. 1.

FIG. 5 shows a schematic block diagram of a decorrelator 520 that may be configured to operate as the decorrelator 120. The decorrelator 520 comprises a first decorrelating filter 526 and a second decorrelating filter 528. The first decorrelating filter 526 and the second decorrelating filter 528 are configured to both receive the processed signal s (512), e.g., from the signal processor. The decorrelator 520 is configured to combine the processed signal 512 and an output signal 523 of the first decorrelating filter 526 to obtain the first decorrelated signal 522 (r1) and to combine an output signal 525 of the second correlating filter 528 to obtain the second decorrelated signal 524 (r2). For combining of signals, the decorrelator 520 may be configured to convolve signals with impulse responses and/or to multiply spectral values with real and/or imaginary values. Alternatively or in addition, other operations may be executed such as divisions, sums, differences or the like.

The decorrelating filters 526 and 528 may be configured to reverberate or delay the processed signal 512. The decorrelating filters 526 and 528 may comprise a finite impulse response (FIR) and/or an infinite impulse response (IIR) filter. For example, the decorrelating filters 526 and 528 may be configured to convolve the processed signal 512 with an impulse response obtained from a noise signal that decays or exponentially decays over time and/or frequency. This allows for generating a decorrelated signal 523 and/or 525 that comprises a reverberation with respect to the signal 512. A reverberation time of the reverberation signal may comprise, for example, a value between 50 and 1000 ms, between 80 and 500 ms and/or between 120 and 200 ms. The reverberation time may be understood as the duration it takes for the power of the reverberation to decay to a small value after it had been excited by an impulse, e.g. to decay to 60 dB below the initial power. Advantageously, the decorrelating filters 526 and 528 comprise IIR-filters. This allows for reducing an amount of calculation when at least some of the filter coefficients are set to zero such that calculations for this (zero-) filter coefficient may be skipped. Optionally, a decorrelating filter can comprise more than one filter, where the filters are connected in series and/or in parallel.

In other words, reverberation comprises a decorrelating effect. The decorrelator may be configured to not just decorrelate, but also to only slightly change the sonority. Technically, reverberation may be regarded as a linear time invariant (LTI)-system that may be characterized considering its impulse response. A length of the impulse response is often stated as RT60 for reverberation. That is the time after which the impulse response is decreased by 60 dB. Reverberation may have a length of up to one second or even up to some seconds. The decorrelator may be implemented comprising a similar structure as reverberation but comprising different settings for parameters that influence the length of the impulse response.

Figure 6A:
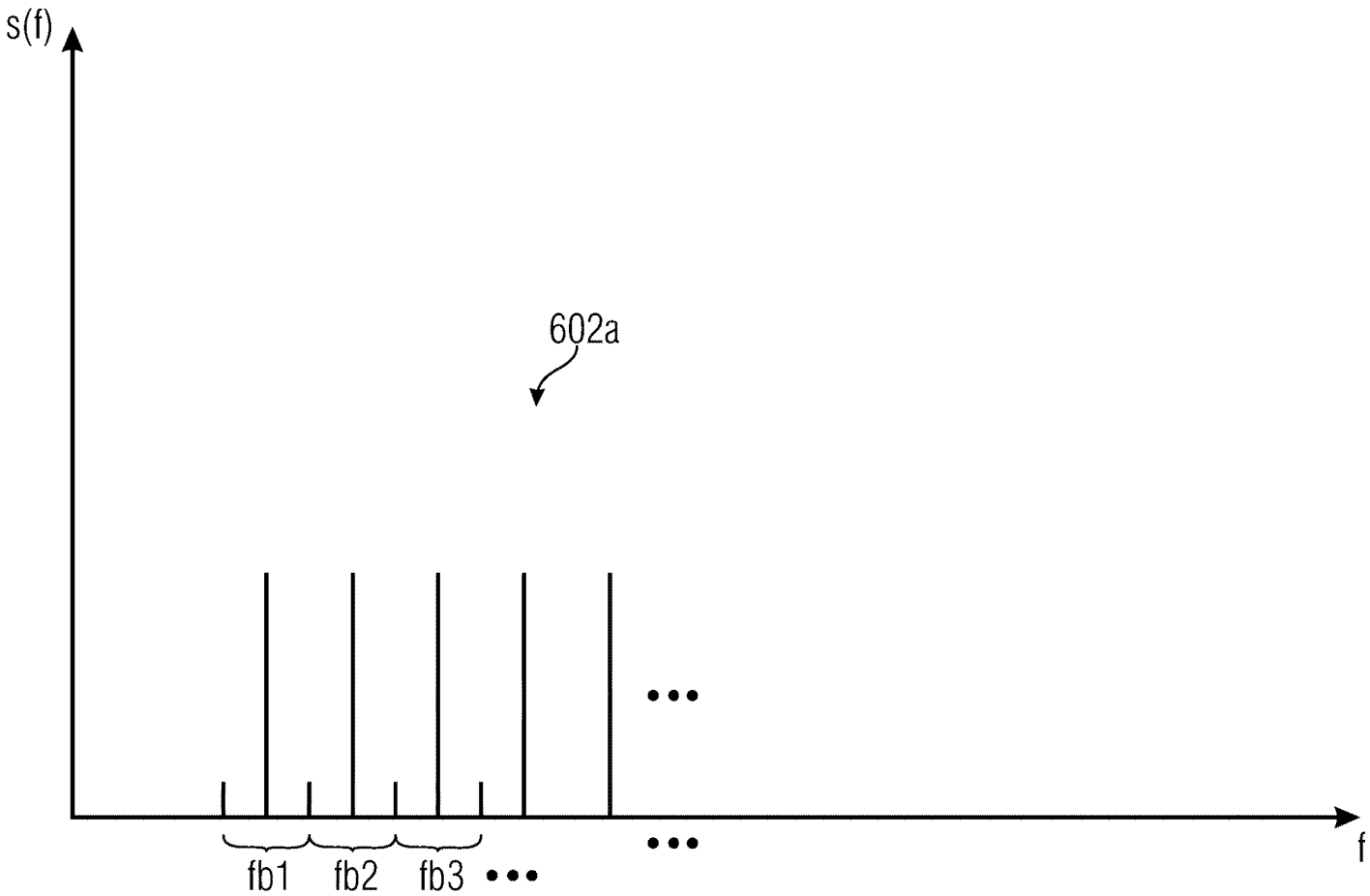
FIG. 6*a* shows a schematic diagram comprising a spectrum of an audio signal comprising at least one transient (short-time) signal portion.

FIG. 6*a* shows a schematic diagram comprising a spectrum of an audio signal 602*a* comprising at least one transient (short-time) signal portion. A transient signal portion leads to a broadband spectrum. The spectrum is depicted as magnitudes S(f) over frequencies f, wherein the spectrum is subdivided into a multitude of frequency bands b1-3. The transient signal portion may be determined in one or more of the frequency bands at b1-3.

Figure 6B:
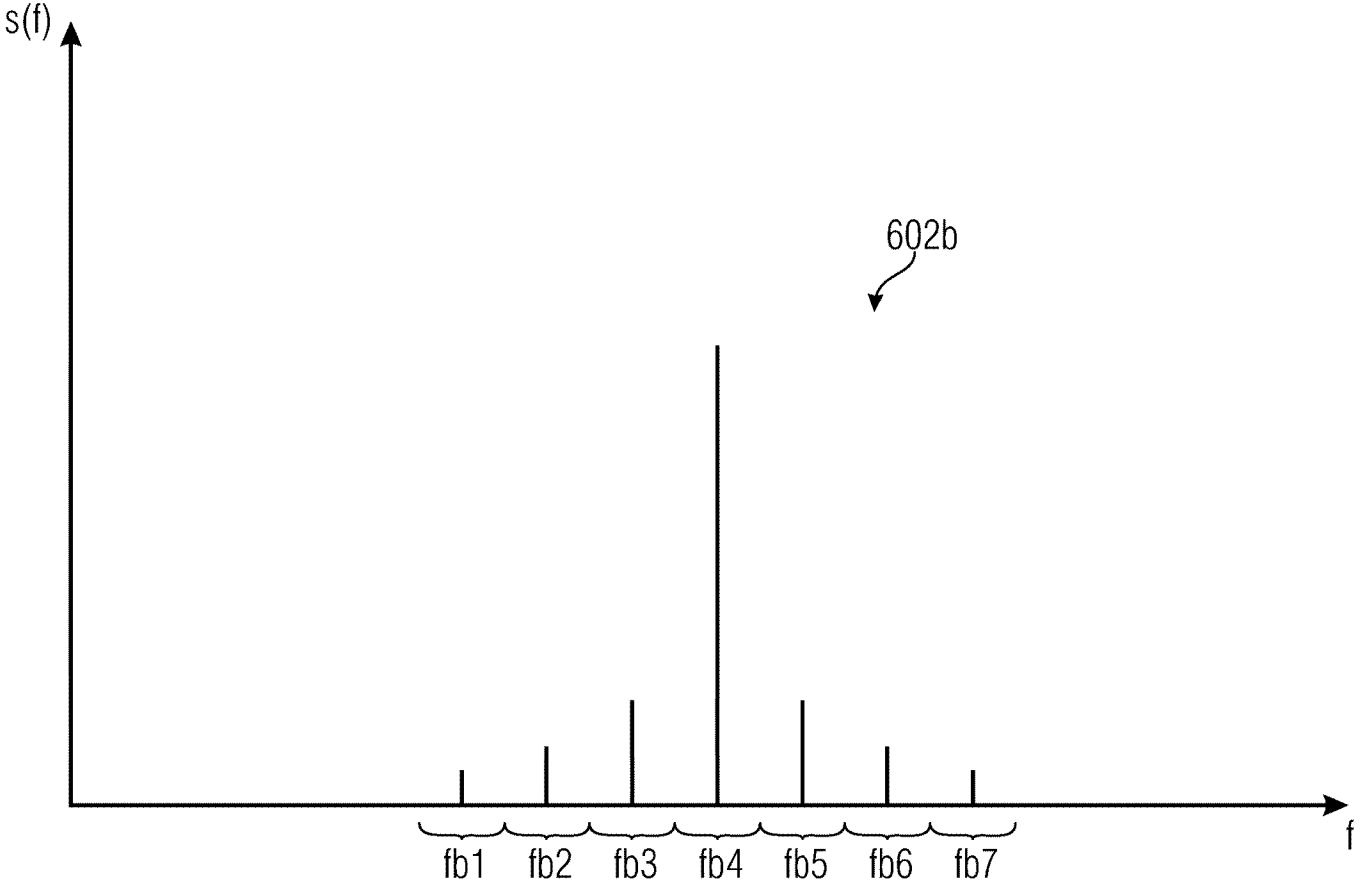
FIG. 6*b* shows a schematic spectrum of an audio signal comprising a tonal component.

FIG. 6*b* shows a schematic spectrum of an audio signal 602*b* comprising a tonal component. An example of a spectrum is depicted in seven frequency bands fb1-7. The frequency band fb4 is arranged in the center of the frequency bands fb1-7 and comprises a maximum magnitude S(f) when compared to the other frequency bands fb1-3 and fb5-7. Frequency bands with increasing distance with respect to the center frequency (frequency band fb4) comprise harmonic repetitions of the tonal signal with decreasing magnitudes. The signal processor may be configured to determine the tonal component, for example, by evaluating the magnitude S(f). An increasing magnitude S(f) of a tonal component may be incorporated by the signal processor by decreased spectral weighting factors. Thus, the higher a share of transient and/or tonal components within a frequency band, the less contribution the frequency band may have in the processed signal of the signal processor. For example, the spectral weight for the frequency band fb4 may comprise a value of zero or close to zero or another value indicating that the frequency band fb4 is considered with a low share.

FIG. 7*a* shows a schematic table illustrating a possible transient processing 211 performed by a signal processor such as the signal processor 110 and/or 210. The signal processor is configured to determine an amount, e.g., a share, of transient components in each of the frequency bands of the representation of the audio signal in the frequency domain to be considered. An evaluation may comprise a determining of an amount of the transient components with a starter value comprising at least a minimum value (for example 1) and at most a maximum value (for example 15), wherein a higher value may indicate a higher amount of transient components within the frequency band. The higher the amount of transient components in the frequency band, the lower the respective spectral weight, for example the spectral weight 217, may be. For example, the spectral weight may comprise a value of at least a minimum value such as 0 and of at most a maximum value such as 1. The spectral weight may comprise a plurality of values between the minimum and the maximum value, wherein the spectral weight may indicate a consideration-factor and/or a consideration-factor of the frequency band for later processing. For example, a spectral weight of 0 may indicate that the frequency band is to be attenuated completely. Alternatively, also other scaling ranges may be implemented, i.e., the table depicted in FIG. 7*a* may be scaled and/or transformed to tables with other step sizes with respect to an evaluation of the frequency band being a transient frequency band and/or of a step size of the spectral weight. The spectral weight may even vary continuously.

FIG. 7*b* shows an exemplary table that illustrates a possible tonal processing as it may be executed, for example, by the tonal processing stage 213. The higher an amount of tonal components within the frequency band, the lower the respective spectral weight 219 may be. For example, the amount of tonal components in the frequency band may be scaled between a minimum value of 1 and a maximum value of 8, wherein the minimum value indicates that no or almost no tonal components are comprised by the frequency band. The maximum value may indicate that the frequency band comprises a large amount of tonal components. The respective spectral weight, such as the spectral weight 219 may also comprise a minimum value and a maximum value. The minimum value, for example, 0.1, may indicate that the frequency band is attenuated almost completely or completely. The maximum value may indicate that the frequency band is almost unattenuated or completely unattenuated. The spectral weight 219 may accept one of a multitude of values including the minimum value, the maximum value and advantageously at least one value between the minimum value and the maximum value. Alternatively, the spectral weight may decrease for a decreased share of tonal frequency bands such that the spectral weight is a consideration factor.

The signal processor may be configured to combine the spectral weight for transient processing and/or the spectral weight for tonal processing with the spectral values of the frequency band as it is described for the signal processor 210. For example, for a processed frequency band an average value of the spectral weight 217 and/or 219 may be determined by the combining stage 215. The spectral weights of the frequency band may be combined, for example multiplied, with the spectral values of the audio signal 102. Alternatively, the combining stage may be configured to compare both spectral weights 217 and 219 and/or to select the lower or higher spectral weight of both and to combine the selected spectral weight with the spectral values. Alternatively, the spectral weights may be combined differently, for example as a sum, as a difference, as a quotient or as a factor.

A characteristic of an audio signal may vary over time. For example, a radio broadcast signal may first comprise a speech signal (prominent sound source signal) and afterwards a music signal (non-prominent sound source signal) or vice versa. Also, variations within a speech signal and/or a music signal may occur. This may lead to rapid changes of spectral weights and/or weighting factors. The signal processor and/or the controller may be configured to additionally adapt the spectral weights and/or the weighting factors to decrease or to limit variations between two frames, for example by limiting a maximum step size between two signal frames. One or more frames of the audio signal may be summed up in a time period, wherein the signal processor and/or the controller may be configured to compare spectral weights and/or weighting factors of a previous time period, e.g. one or more previous frames and to determine if a difference of spectral weights and/or weighting factors determined for an actual time period exceeds a threshold value. The threshold value may represent, for example, a value that leads to annoying effects for a listener. The signal processor and/or the controller may be configured to limit the variations such that such annoying effects are reduced or prevented. Alternatively, instead of the difference, also other mathematical expressions such as a ratio may be determined for comparing the spectral weights and/or the weighting factors of the previous and the actual time period.

In other words, each frequency band is assigned a feature comprising an amount of tonal and/or transient characteristics.

Figure 8:
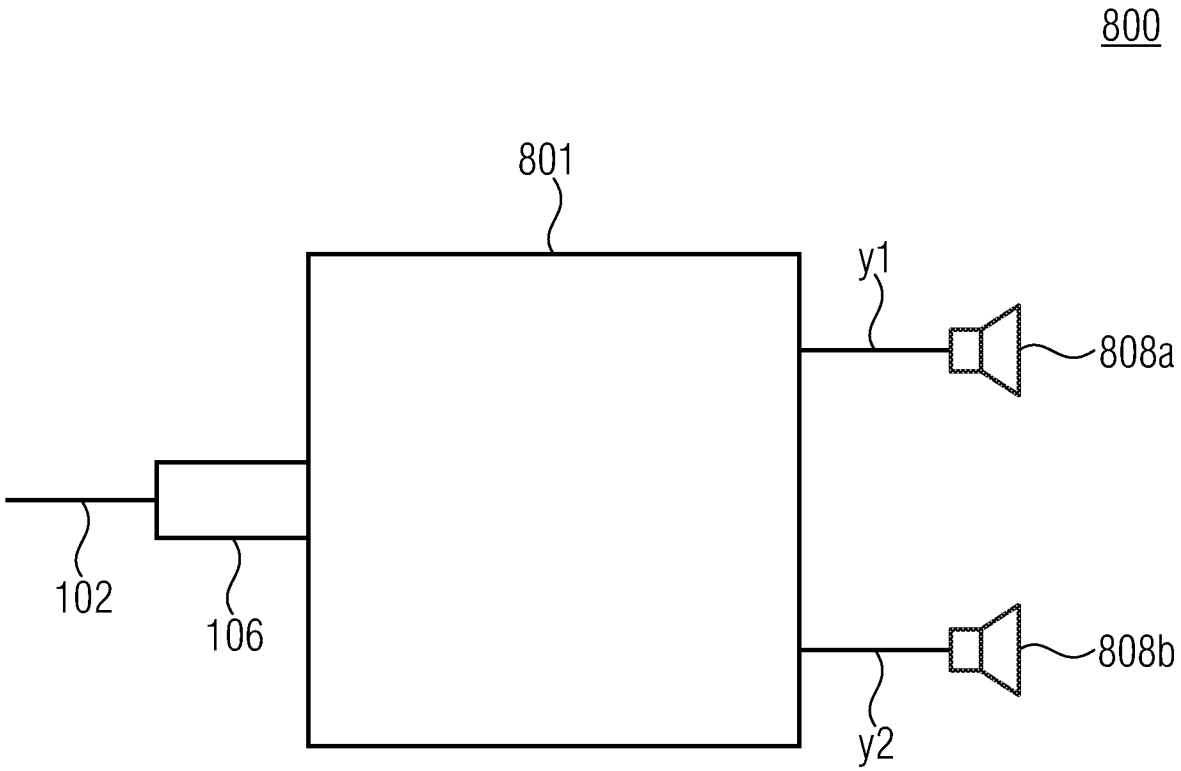
FIG. 8 shows a schematic block diagram of a sound enhancing system comprising an apparatus for enhancing the audio signal.

FIG. 8 shows a schematic block diagram of a sound enhancing system 800 comprising an apparatus 801 for enhancing the audio signal 102. The sound enhancing system 800 comprises a signal input 106 configured to receive the audio signal and to provide the audio signal to the apparatus 801. The sound enhancing system 800 comprises two loudspeakers 808*a* and 808*b*. The loudspeaker 808*a* is configured to receive the signal y1. The loudspeaker 808*b* is configured to receive the signal y2 such that by means of the loudspeakers 808*a* and 808*b* the signals y1 and y2 may be transferred to sound waves or signals. The signal input 106 may be a wired or wireless signal input, such as a radio antenna. The apparatus 801 may be, for example, the apparatus 100 and/or 200.

The correlated signal z is obtained by applying a processing that enhances transient and tonal components (qualitatively inverse of the suppression for computing the signal s). The combination performed by the combiner may be linear expressed by y (y1/y2)=scaling factor 1·z+scaling factor 2·scaling factor (r1/r2). The scaling factors may be obtained by predicting the perceived intensity of decorrelation.

Alternatively, the signals y1 and/or y2 may be further processed before being received by a loudspeaker 808*a* and/or 808*b*. For example, the signals y1 and/or y2 may be amplified, equalized or the like such that a signal or signals derived by processing the signal y1 and/or y2 are provided to the loudspeakers 808*a* and/or 808*b*.

Artificial reverberation added to the audio signal may be implemented such that the level of the reverberation is audible, but not too loud (intensive). Levels that are audible or annoying may be determined in tests and/or simulations. A level that is too high does not sound good because the clarity suffers, percussive sounds are slurred in time, etc. A target level may depend from the input signal. If the input signal comprises a low amount of transients and comprises a low amount of tones with frequency modulations, then the reverberation is audible with a lower degree and the level may be increased. Similar applies for a decorrelation as the decorrelator may comprise a similar active principle. Thus, an optimal intensity of the decorrelator may depend on the input signal. The computation may be equal, with modified parameters. The decorrelation executed in the signal processor and in the controller may be performed with two decorrelators that may be structurally equal but are operated with different sets of parameters. The decorrelation processors are not limited to two-channel stereo signals but may also be applied to channels with more than two signals. The decorrelation may be quantified with a correlation metrics that may comprise up to all values for decorrelation of all signal pairs.

A finding of the invented method is to generate spatial cues and to introduce the spatial cues to the signal such that the processed signal creates the sensation of a stereophonic signal. The processing may be regarded as being designed according to the following criteria:

1. Direct sound sources that have high intensity (or loudness level) are localized in the center. These are prominent direct sound sources, for example a singer or loud instrument in a musical recording.
2. Ambient sounds are perceived as being diffuse.
3. Diffuseness is added to direct sound sources having low intensity (i.e., low loudness levels), possibly to a smaller extent than to ambient sounds.
4. The processing should sound natural and should not introduce artifacts.

The design criteria are consistent with common practice in the production of audio recordings and with signal characteristics of stereophonic signals:

1. Prominent direct sounds are typically panned to the center, i.e. they are mixed with negligible ICLD and ICTD. These signals exhibit a high coherence.
2. Ambient sounds exhibit a low coherence.
3. When recording multiple direct sources in a reverberant environment, e.g. opera singers with accompanying orchestra. the amount of diffuseness of each direct sound is related to their distance to the microphones, because the ratio between the direct signal and the reverberation decreases when the distance to the microphone is increased. Therefore, sounds that are captured with low intensity are typically less coherent (or vice versa, more diffuse) than the prominent direct sounds.

The processing generates the spatial information by means of decorrelation. In other words, the ICC of the input signals is decreased. Only in extreme cases the decorrelation leads to completely uncorrelated signals. Typically, a partial decorrelation is achieved and desired. The processing does not manipulate the directional cues (i.e., ICLD and ICTD). The reason for this restriction is that no information about the original or intended position of direct sound sources is available.

According to above design criteria, the decorrelation is applied selectively to the signal components in a mixture signal such that:

1. No or little decorrelation is applied to signal components as discussed in design criterion 1.
2. Decorrelation is applied to signal components as discussed in design criterion 2. This decorrelation largely contributes to the perceived width of the mixture signal that is obtained at the output of the processing.

Decorrelation is applied to signal components as discussed in design criterion 3, but to a lesser extent than to signal components as discussed in design criterion 2.

This processing is illustrated by means of a signal model that represents the input signal x as an additive mixture of a foreground signal $x_a$ and a background signal $x_b$, i.e., $x=x_a+x_b$. The foreground signal comprises all signal components as discussed in design criterion 1. The background signal comprises all signal components as discussed in design criterion 2. All signal components as discussed in design criterion 3 are not exclusively assigned to either one of the separated signal components but are partially contained in the foreground signal and in the background signal.

The output signal y is computed as $y=y_a+y_b$, where $y_b$ is computed by decorrelating $x_b$, and $y_a=x_a$ or, alternatively, $y_a$ is computed by decorrelating $x_a$. In other words, the background signal is processed by means of decorrelation and the foreground signal is not processed by means of decorrelation or is processed by means of decorrelation, but to a lesser extent than the background signal. FIG. 9*b* illustrates this processing.

This approach does not only meet the design criteria above. An additional advantage is that the foreground signal can be prone to undesired coloration when applying decorrelation, whereas the background can be decorrelated without introducing such audible artifacts. Therefore, the described processing yields better sound quality compared to a processing that applies decorrelation equally to all signal components in the mixture.

So far, the input signal is decomposed into two signals denoted as "foreground signal" and "background signal" that are separately processed and combined to the output signal. It should be noted that equivalent methods are feasible that follow the same rationale.

The signal decomposition is not necessarily a processing that outputs audio signals, i.e. signals that resemble the shape of the waveform over time. Instead, the signal decomposition can result in any other signal representation that can be used as the input to the decorrelation processing and subsequently transformed into a waveform signal. An example for such signal representation is a spectrogram that is computed by means of Short-term Fourier transform. In general, invertible and linear transforms lead to appropriate signal representations.

Alternatively, the spatial cues are selectively generated without the preceding signal decomposition by generating the stereophonic information based on the input signal x. The derived stereophonic information is weighted with time variant and frequency-selective values and combined with the input signal. The time-variant and frequency-selective weighting factors are computed such that they are large at time-frequency regions that are dominated by the background signal and are small at time-frequency regions that are dominated by the foreground signal. This can be formalized by quantifying the time-variant and frequency-selective ratio of background signal and foreground signal. The weighting factors can be computed from the background-to-foreground ratio, e.g. by means of monotonically increasing functions.

Alternatively, the preceding signal decomposition can result in more than two separated signals.

Figure 9A:
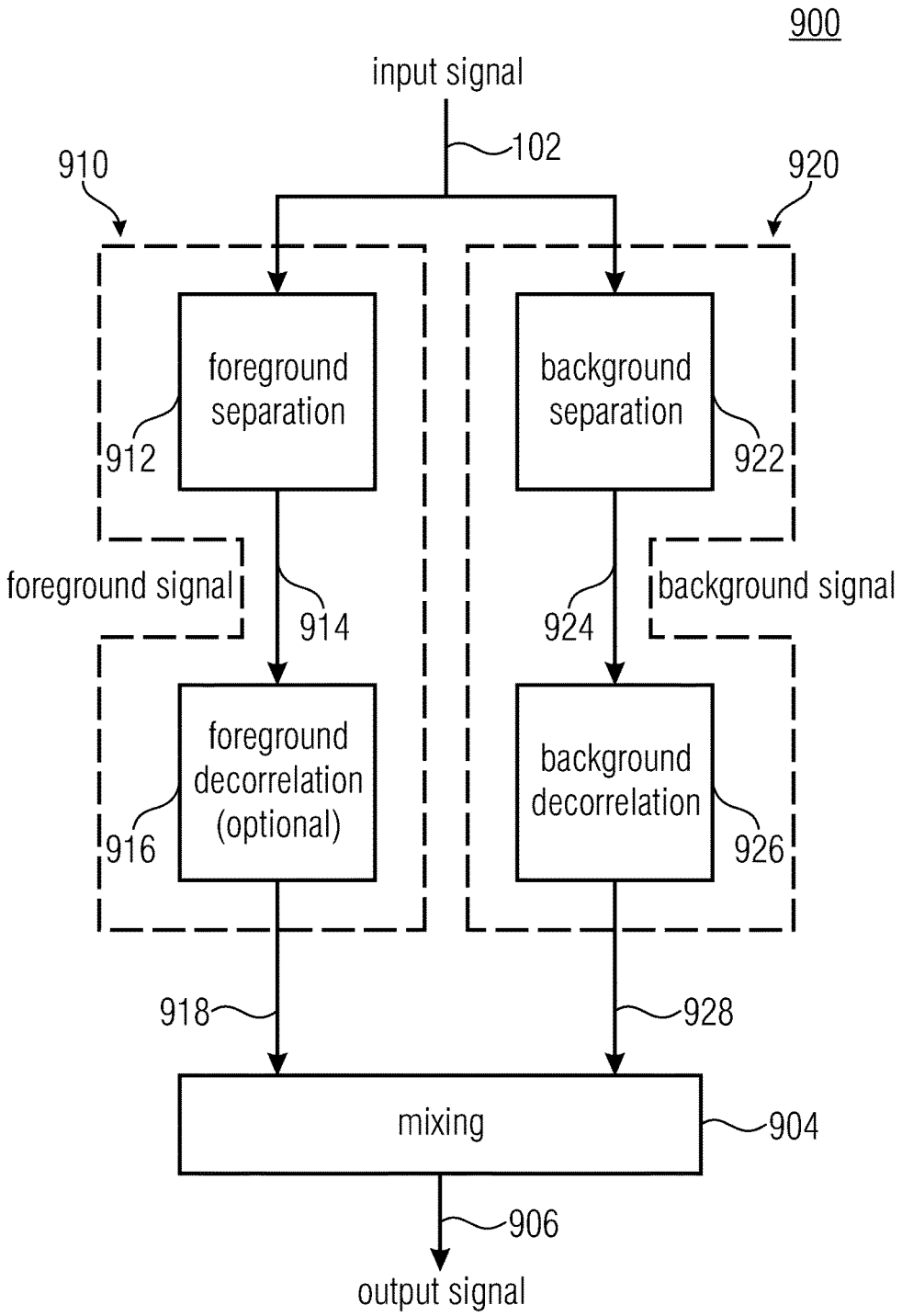
FIG. 9*a* shows a schematic block diagram of a processing of the input signal according to a foreground/background processing.
Figure 9B:
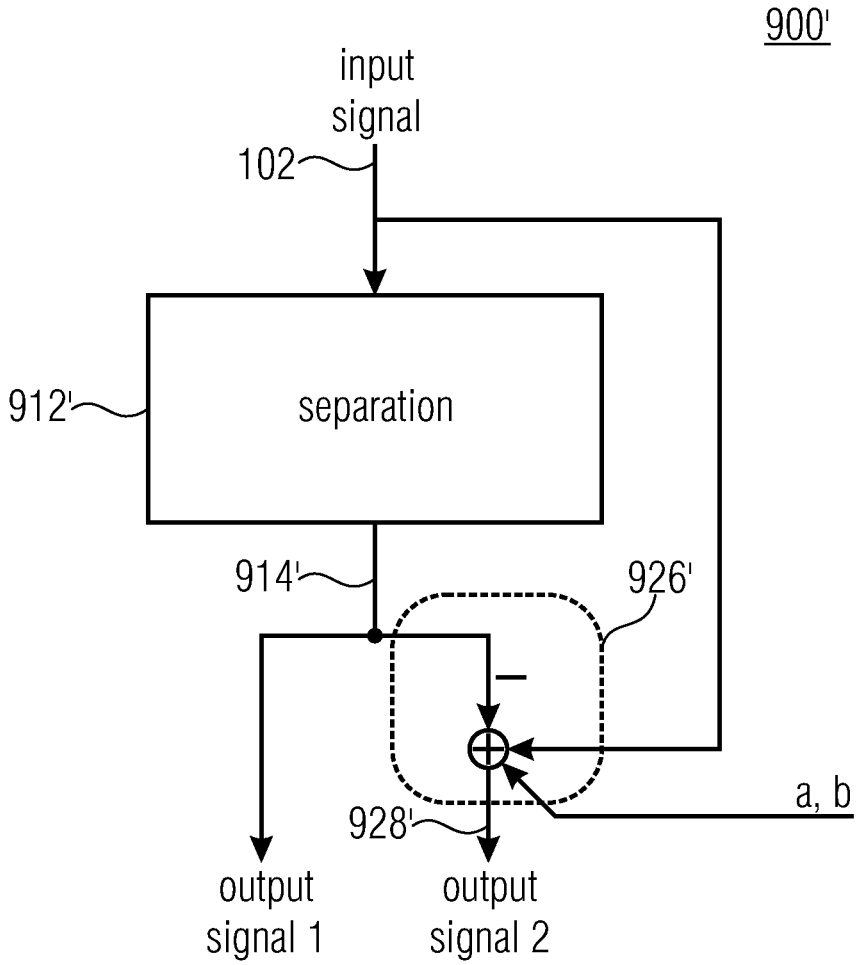
FIG. 9*b* illustrates the separation of the input signal into a foreground and a background signal.

FIGS. 9*a* and 9*b* illustrate the separation of the input signal into a foreground and a background signal, e.g., by suppressing (reducing or eliminating) tonal transient portions in one of the signals.

A simplified processing is derived by using the assumption that the input signal is an additive mixture of the foreground signal and the background signal. FIG. 9*b* illustrates this. Here, separation 1 denotes the separation of either the foreground signal or of the background signal. If the foreground signal is separated, output 1 denotes the foreground signal and output 2 is the background signal. If the background signal is separated, output 1 denotes the background signal and output 2 is the foreground signal.

The design and implementation of the signal separation method is based on the finding that foreground signals and background signals have distinct characteristics. However, deviations from an ideal separation, i.e. leakage of signal components of the prominent direct sound sources into the background signal or leakage of ambient signal components into the foreground signal, are acceptable and do not necessarily impair the sound quality of the final result.

For temporal characteristics, in general it can be observed that the temporal envelopes of subband signals of foreground signals feature stronger amplitude modulations than the temporal envelopes of subband signals of background signals. In contrast, background signals are typically less transient (or percussive, i.e. more sustained) than foreground signals.

For spectral characteristics, in general it can be observed that the foreground signals can be more tonal. In contrast, background signals are typically noisier than foreground signals.

For phase characteristics, in general it can be observed that the phase information of background signals is more noisy than of foreground signals. The phase information for many examples of foreground signals is congruent across multiple frequency bands.

Signals featuring characteristics that are similar to prominent sound source signals are more likely foreground signals than background signals. Prominent sound source signals are characterized by transitions between tonal and noisy signal components, where the tonal signal components are time-variant filtered pulse trains whose fundamental frequency is strongly modulated. Spectral processing may be based on these characteristics, the decomposition may be implemented by means of spectral subtraction or spectral weighting.

Spectral subtraction is performed, for example, in the frequency domain, where the spectra of short frames of successive (possibly overlapping) portions of the input signal are processed. The basic principle is to subtract an estimate of the magnitude spectrum of an interfering signal from the magnitude spectra of the input signals which is assumed to be an additive mixture of a desired signal and an interfering signal. For the separation of the foreground signal, the desired signal is the foreground and the interfering signal is the background signal. For the separation of the background signal, the desired signal is the background and the interfering signal is the foreground signal.

Spectral weighting (or Short-term spectral attenuation) follows the same principle and attenuates the interfering signal by scaling the input signal representation. The input signal x(t) is transformed using a Short-time Fourier transform (STFT), a filter bank or any other means for deriving a signal representation with multiple frequency bands X(n, k), with frequency band index n and time index k. The frequency domain representations of the input signals are processed such that the subband signals are scaled with time variant weights G(n,k), $$Y(n,k)=G(n,k)X(n,k) \quad ((3)$$

Figure 10:
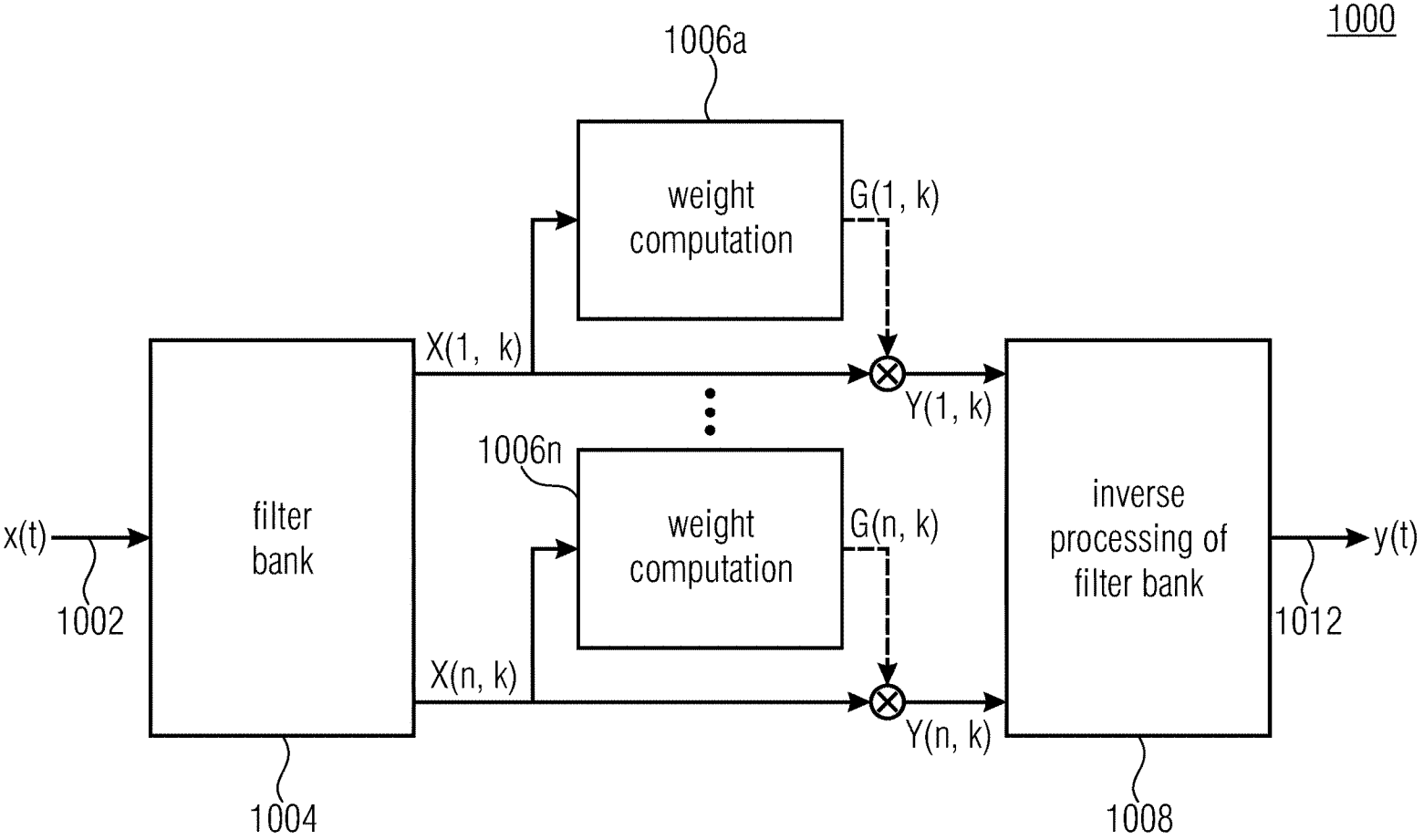
FIG. 10 shows a schematic block diagram and also an apparatus configured to apply spectral weights to an input signal.

The result of the weighting operation Y(n,k) is the frequency domain representation of the output signal. The output time signal y(t) is computed using the inverse processing of the frequency domain transform, e.g. the Inverse STFT. FIG. 10 illustrates the spectral weighting.

Decorrelation refers to a processing of one or more identical input signal such that multiple output signals are obtained that are mutually (partially or completely) uncorrelated, but which sound similar to the input signal. The correlation between two signals can be measured by means of the correlation coefficient or normalized correlation coefficient. The normalized correlation coefficient NCC in frequency bands for two signals $X_1(n,k)$ and $X_2(n,k)$ is defined as $$NCC(n,k)=\frac{|\phi_{1,2}(n,k)|}{\sqrt{\phi_{1,1}(n,k)\phi_{2,2}(n,k)}}, \quad (4)$$

where $\phi_{1,1}$ and $\phi_{2,2}$ are the auto power spectral densities (PSD) of the first and second input signal, respectively, and $\phi_{1,2}$ is the cross-PSD, given by $$\phi_{i,j}(n,k)=\varepsilon\{X_i(n,k)X_j^*(n,k)\},\ i,j=1,2, \quad (5)$$

where ε{•} is the expectation operation and X* denotes the complex conjugate of X.

Decorrelation can be implemented by using decorrelating filters or by manipulating the phase of the input signals in the frequency domain. An example for decorrelating filters is the allpass filter, which by definition does not change the magnitude spectrum of the input signals but only their phase. This leads to neutrally sounding output signals in the sense that the output signals sound similar to the input signals. Another example is reverberation, which can also be modeled as a fitter or a linear time-invariant system. In general, decorrelation can be achieved by adding multiple delayed (and possibly filtered) copies of the input signal to the input signal. In mathematical terms, artificial reverberation can be implemented as convolution of the input signal with the impulse response of the reverberating (or decorrelating) system. When the delay time is small. e.g. smaller than 50 ms, the delayed copies of the signal are not perceived as separate signals (echoes). The exact value of the delay time that leads to the sensation of echoes is the echo threshold and depends on spectral and temporal signal characteristics. It is for example smaller for impulse like sounds than for sound whose envelope rises slowly. For the problem at hand it is desired to use delay times that are smaller than the echo threshold.

In the general case, the decorrelation processes an input signal having N channels and outputs a signal having M channels such that the channel signals of the output are mutually uncorrelated (partially or completely).

In many application scenarios for the described method it is not appropriate to constantly process the input signal but to activate it and to control its impact based on an analysis of the input signal. An example is FM broadcasting, where the described method is applied only when impairments of the transmission lead to a complete or partial loss of stereophonic information. Another example is listening to a collection of musical recordings, where a subset of the recordings are monophonic and another subset are stereo recordings. Both scenarios are characterized by a time-varying amount of stereophonic information of the audio signals. This entails a control of the activation and the impact of the stereophonic enhancement, i.e. a control of the algorithm.

The control is implemented by means of an analysis of the audio signals that estimates the spatial cues (ICLD, ICTD and ICC, or a subset thereof) of the audio signals. The estimation can be performed in a frequency selective manner. The output of the estimation is mapped to a scalar value that controls the activation or the impact of the processing. The signal analysis processes the input signal or, alternatively, the separated background signal.

A straightforward way of controlling the impact of the processing is to decrease its impact by adding a (possibly scaled) copy of the input signal to the (possibly scaled) output signal of the stereophonic enhancement. Smooth transitions of the control are obtained by low-pass filtering the control signal over time.

FIG. 9*a* shows a schematic block diagram of a processing 900 of the input signal 102 according to a foreground 910/background 912 processing. The input signal 102 is separated such that a foreground signal 914 may be processed. In a step 916 decorrelation is performed to the foreground signal 914. Step 916 is optional. Alternatively, the foreground signal 914 may remain unprocessed, i.e. undecorrelated. In a step 922 of a processing path 920, a background signal 924 is extracted, i.e., filtered. In a step 926 the background signal 924 is decorrelated. In a step 904 a decorrelated foreground signal 918 (alternatively the foreground signal 914) and a decorrelated background signal 928 are mixed such that an output signal 906 is obtained. In other words, FIG. 9*a* shows a block diagram of the stereophonic enhancement. A foreground signal and a background signal is computed. The background signal is processed by decorrelation. Optionally, the foreground signal can be processed by decorrelation, but to a lesser extent than the background signal. The processed signals are combined to the output signal.

FIG. 9*b* illustrates a schematic block diagram of a processing 900' comprising a separation step 912' of the input signal 102. The separation step 912' may be performed as it was described above. A foreground signal (output signal 1) 914' is obtained by the separation step 912'. A background signal 928' is obtained by combining the foreground signal 914', the weighting factors a and/or b and the input signal 102 in a combining step 926'. A background signal (output signal 2) 928' is obtained by the combining step 926'.

FIG. 10 shows a schematic block diagram and also an apparatus 1000 configured to apply spectral weights to an input signal 1002 which may be, for example, the input signal 1002. The input signal 1002 in the time domain is divided into subbands X(1,k) . . . X(n,k) in the frequency domain. A filterbank 1004 is configured to divide the input signal 1002 into N subbands. The apparatus 1000 comprises N computation instances configured to determine the transient spectral weight and/or the tonal spectral weight G(1,k) . . . G(n,k) for each of the N subbands at time instance (frame) k. The spectral weights G(1,k) . . . G(n,k) are combined with the subband signal X(1,k) . . . X(n,k), such that weighted subband signals Y(1,k) . . . Y(n,k) are obtained. The apparatus 1000 comprises an inverse processing unit 1008 configured to combine the weighted subband signals to obtain a filtered output signal 1012 indicated as y(t) in the time domain. The apparatus 1000 may be a part of the signal processor 110 or 210. In other words, FIG. 10 illustrates the decomposition of an input signal into a foreground signal and a background signal.

Figure 11:
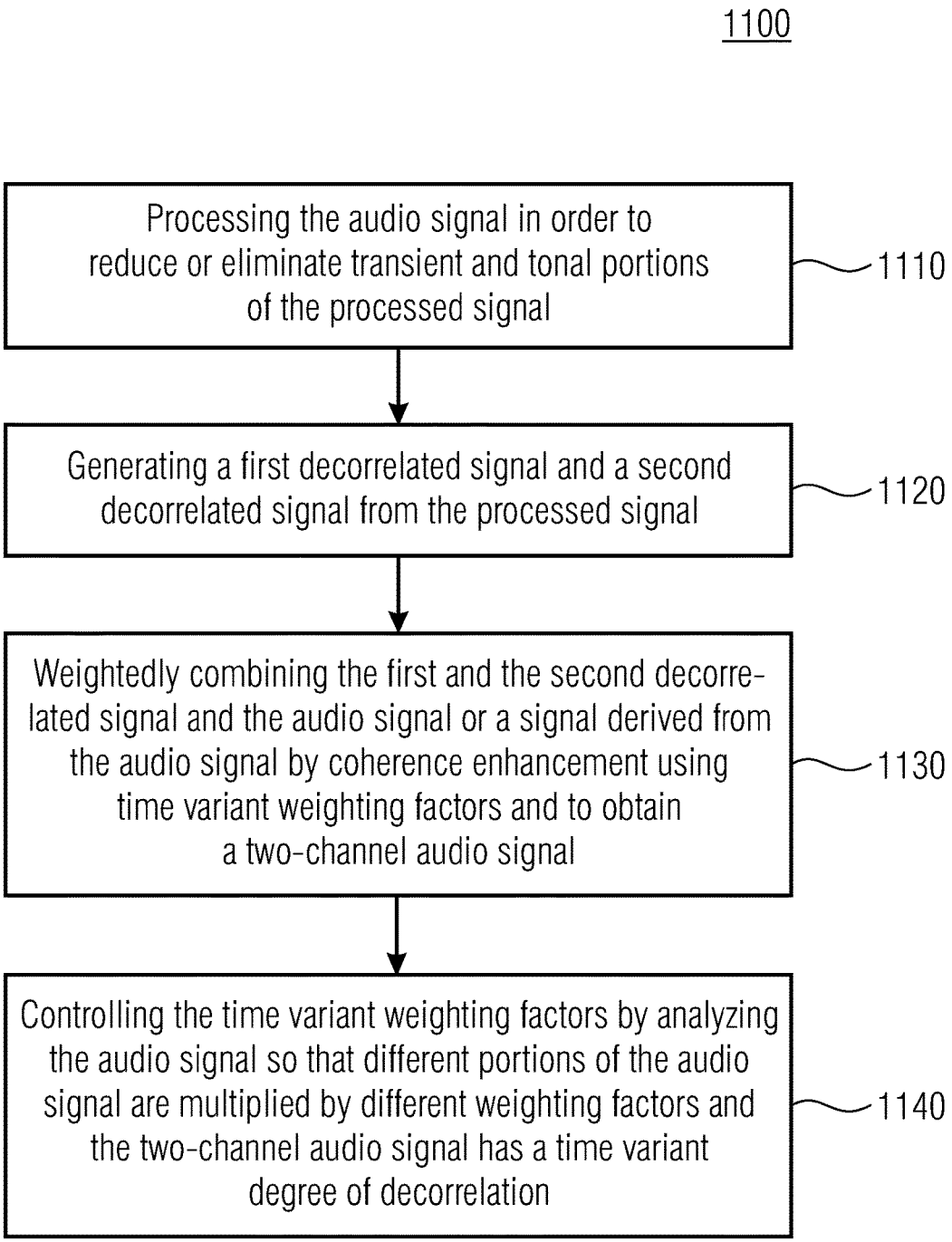
FIG. 11 shows a schematic flowchart of a method for enhancing an audio signal.

FIG. 11 shows a schematic flowchart of a method 1100 for enhancing an audio signal. The method 1100 comprises a first step 1110 in which the audio signal is processed in order to reduce or eliminate transient and tonal portions of the processed signal. The method 1100 comprises a second step 1120 in which a first decorrelated signal and a second decorrelated signal are generated from the processed signal. In a step 1130 of method 1100 the first decorrelated signal, the second decorrelated signal and the audio signal or a signal derived from the audio signal by coherence enhancement are weightedly combined by using time variant weighting factors to obtain a two-channel audio signal. In a step 1140 of method 1100 the time variant weighting factors are controlled by analyzing the audio signal so that different portions of the audio signal are multiplied by different weighting factors and the two-channel audio signal has a time variant degree of a decorrelation.

In the following details will be set forth for illustrating the possibility of determining the perceived level of decorrelation based on a loudness measure. As will be shown, a loudness measure may allow for predicting a perceived level of reverberation. As was stated above, reverberation also refers to decorrelation such that the perceived level of reverberation may also be regarded as a perceived level of decorrelation, wherein for a decorrelation, reverberation may be shorter than one second, for example shorter than 500 ms, shorter than 250 ms or shorter than 200 ms.

Figure 12:
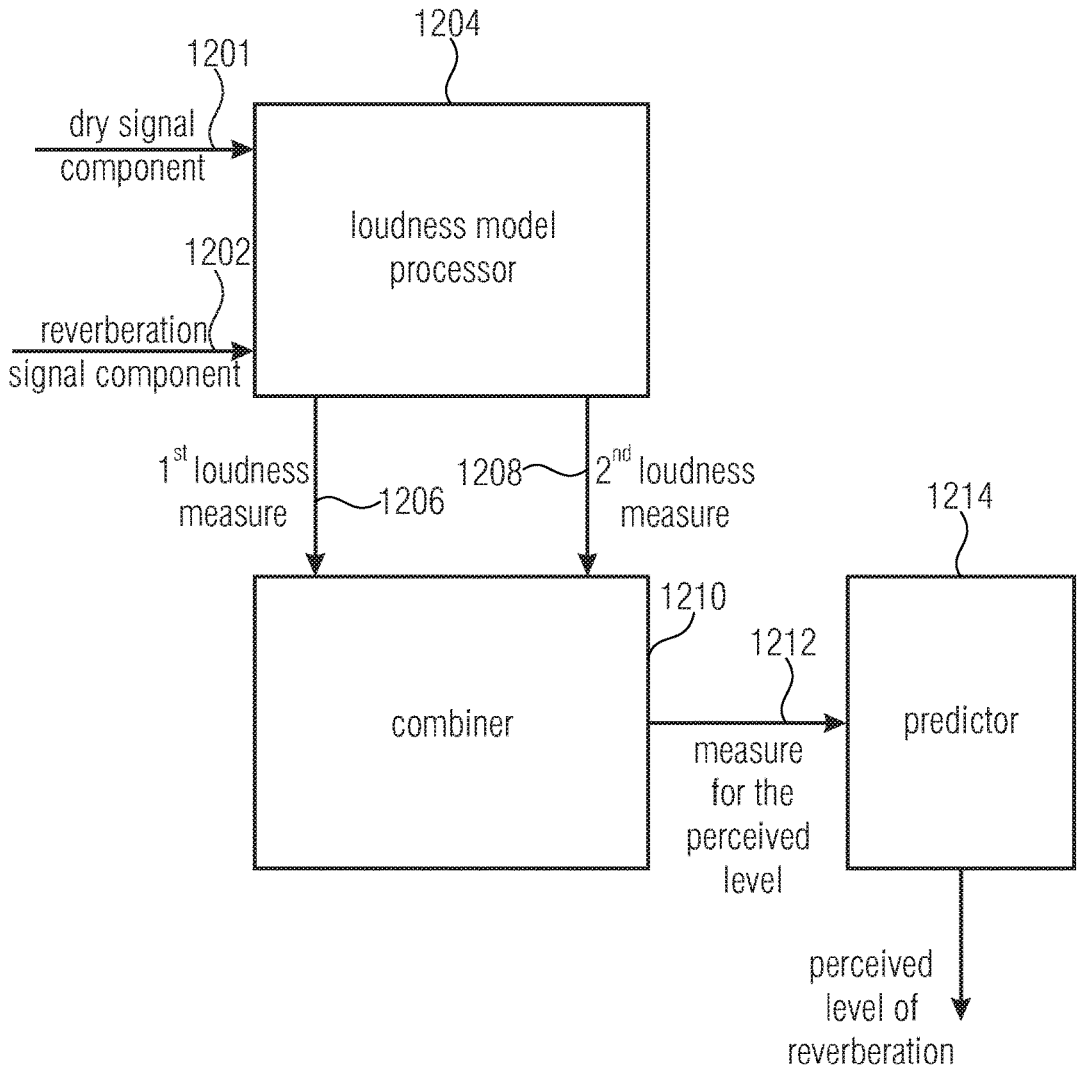
FIG. 12 illustrates an apparatus for determining a measure for a perceived level of reverberation/decorrelation in a mix signal comprising a direct signal component or dry signal component and a reverberation signal component.

FIG. 12 illustrates an apparatus for determining a measure for a perceived level of reverberation in a mix signal comprising a direct signal component or dry signal component 1201 and a reverberation signal component 1202. The dry signal component 1201 and the reverberation signal component 1202 are input into a loudness model processor 1204. The loudness model processor is configured for receiving the direct signal component 1201 and the reverberation signal component 1202 and is furthermore comprising a perceptual filter stage 1204*a* and a subsequently connected loudness calculator 1204*b* as illustrated in FIG. 13*a*. The loudness model processor generates, at its output, a first loudness measure 1206 and a second loudness measure 1208. Both loudness measures are input into a combiner 1210 for combining the first loudness measure 1206 and the second loudness measure 1208 to finally obtain a measure 1212 for the perceived level of reverberation. Depending on the implementation, the measure for the perceived level 1212 can be input into a predictor 1214 for predicting the perceived level of reverberation based on an average value of at least two measures for the perceived loudness for different signal frames. However, the predictor 1214 in FIG. 12 is optional and actually transforms the measure for the perceived level into a certain value range or unit range such as the Sone-unit range which is useful for giving quantitative values related to loudness. However, other usages for the measure for the perceived level 1212 which is not processed by the predictor 1214 can be used as well, for example, in the controller, which does not necessarily have to rely on a value output by the predictor 1214, but which can also directly process the measure for the perceived level 1212, either in a direct form or advantageously in a kind of a smoothed form where smoothing over time is advantageous in order to not have strongly changing level corrections of the reverberated signal or of a gain factor g.

Particularly, the perceptual filter stage is configured for filtering the direct signal component, the reverberation signal component or the mix signal component, wherein the perceptual filter stage is configured for modeling an auditory perception mechanism of an entity such as a human being to obtain a filtered direct signal, a filtered reverberation signal or a filtered mix signal. Depending on the implementation, the perceptual filter stage may comprise two filters operating in parallel or can comprise a storage and a single filter since one and the same filter can actually be used for filtering each of the three signals, i.e., the reverberation signal, the mix signal and the direct signal. In this context, however, it is to be noted that, although FIG. 13*a* illustrates n filters modeling the auditory perception mechanism, actually two filters will be enough or a single filter filtering two signals out of the group comprising the reverberation signal component, the mix signal component and the direct signal component.

The loudness calculator 1204*b* or loudness estimator is configured for estimating the first loudness-related measure using the filtered direct signal and for estimating the second loudness measure using the filtered reverberation signal or the filtered mix signal, where the mix signal is derived from a super position of the direct signal component and the reverberation signal component.

FIG. 13*c* illustrates four modes of calculating the measure for the perceived level of reverberation. An implementation relies on the partial loudness where both, the direct signal component x and the reverberation signal component r are used in the loudness model processor, but where, in order to determine the first measure EST1, the reverberation signal is used as the stimulus and the direct signal is used as the noise. For determining the second loudness measure EST2, the situation is changed, and the direct signal component is used as a stimulus and the reverberation signal component is used as the noise. Then, the measure for the perceived level of correction generated by the combiner is a difference between the first loudness measure EST1 and the second loudness measure EST2.

However, other computationally efficient embodiments additionally exist which are indicated at lines 2, 3, and 4 in FIG. 13*c*. These more computationally efficient measures rely on calculating the total loudness of three signals comprising the mix signal m, the direct signal x and the reverberation signal n. Depending on the necessitated calculation performed by the combiner indicated in the last column of FIG. 13*c*, the first loudness measure EST1 is the total loudness of the mix signal or the reverberation signal and the second loudness measure EST2 is the total loudness of the direct signal component x or the mix signal component m, where the actual combinations are as illustrated in FIG. 13*c*.

Figure 14:
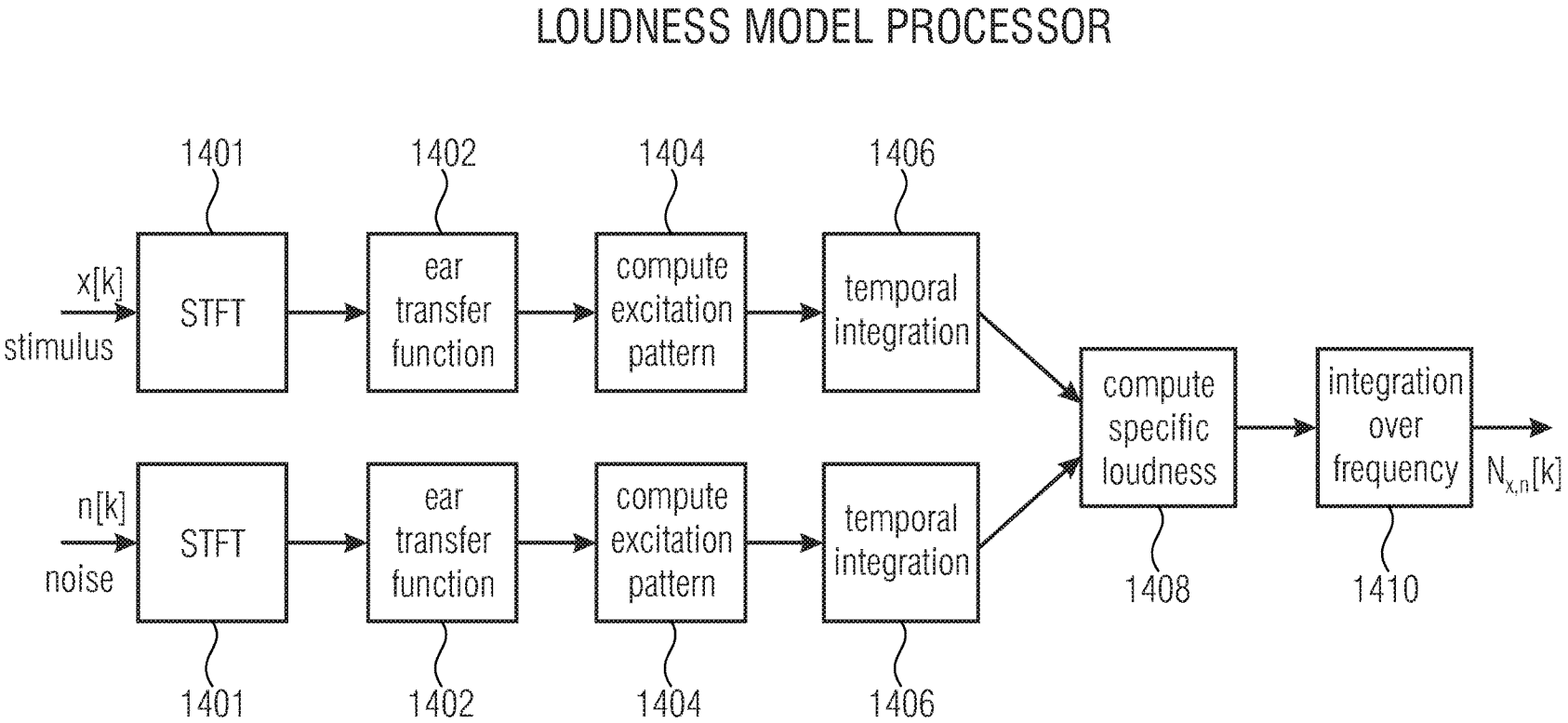
FIG. 14 illustrates in implementation of the loudness model processor which has already been discussed in some aspects with respect to the FIGS. 12, 13*a*, 13*b*, 13*c*.

FIG. 14 illustrates an implementation of the loudness model processor which has already been discussed in some aspects with respect to the FIGS. 12, 13*a*, 13*b*, 13*c*. Particularly, the perceptual filter stage 1204*a* comprises a time-frequency converter 1401 for each branch, where, in the FIG. 3 embodiment, x[k] indicates the stimulus and n[k] indicates the noise. The time/frequency converted signal is forwarded into an ear transfer function block 1402 (Please note that the ear transfer function can alternatively be computed prior to the time-frequency converter with similar results, but higher computational load) and the output of this block 1402 is input into a compute excitation pattern block 1404 followed by a temporal integration block 1406. Then, in block 1408, the specific loudness in this embodiment is calculated, where block 1408 corresponds to the loudness calculator block 1204*b* in FIG. 13*a*. Subsequently, an integration over frequency in block 1410 is performed, where block 1410 corresponds to the adder already described as 1204*c* and 1204*d* in FIG. 13*b*. It is to be noted that block 1410 generates the first measure for a first set of stimulus and noise and the second measure for a second set of stimulus and noise. Particularly, when FIG. 13*b* is considered, the stimulus for calculating the first measure is the reverberation signal and the noise is the direct signal while, for calculating the second measure, the situation is changed and the stimulus is the direct signal component and the noise is the reverberation signal component. Hence, for generating two different loudness measures, the procedure illustrated in FIG. 14 has been performed twice. However, changes in the calculation only occur in block 1408 which operates differently, so that the steps illustrated by blocks 1401 to 1406 only have to be performed once, and the result of the temporal integration block 1406 can be stored in order to compute the first estimated loudness and the second estimated loudness for the implementation depicted in FIG. 13*c*. It is to be noted that, for the other implantation, block 1408 may replaced by an individual block "compute total loudness" for each branch, where, in this implementation it is indifferent, whether one signal is considered to be a stimulus or a noise.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for enhancing an audio signal, comprising:

a signal processor for processing the audio signal in order to reduce or eliminate transient and tonal portions of the processed signal;

a decorrelator for generating a first decorrelated signal and a second decorrelated signal from the processed signal;

a combiner for weightedly combining the first decorrelated signal, the second decorrelated signal and the audio signal or a signal derived from the audio signal by coherence enhancement using time variant weighting factors and to acquire a two-channel audio signal; and a controller for controlling the time variant weighting factors by analyzing the audio signal so that different portions of the audio signal are multiplied by different weighting factors and the two-channel audio signal comprises a time variant degree of decorrelation.

2. The apparatus according to claim 1, wherein the controller is configured to increase the weighting factors for portions of the audio signal allowing a higher degree of decorrelation and to decrease the weighting factors for portions of the audio signal allowing a lower degree of decorrelation.

3. The apparatus according to claim 1, wherein the controller is configured to scale the weighting factors such that a perceived level of decorrelation in the two-channel audio signal remains within a range around a target value, the range extending to ±20% of the target value.

4. The apparatus according to claim 3, wherein the controller is configured to determine the target value by reverberating the audio signal to acquire a reverberated audio signal and by comparing the reverberated audio signal with the audio signal to acquire a result of the comparison, wherein the controller is configured to determine the perceived level of decorrelation based on the result of the comparison.

5. The apparatus according to claim 1, wherein the controller is configured to determine a prominent sound source signal portion in the audio signal and to decrease the weighting factors for the prominent sound source signal portion compared to a portion of the audio signal not comprising a prominent sound source signal; and wherein the controller is configured to determine a non-prominent sound source signal portion in the audio signal and to increase the weighting factors for the non-prominent sound source signal portion compared to a portion of the audio signal not comprising a non-prominent sound source signal.

6. The apparatus according to claim 1, wherein the controller is configured to:

generate a test decorrelated signal from a portion of the audio signal;

derive a measure for a perceived level of decorrelation from the portion of the audio signal and the test decorrelated signal; and to derive the weighting factors from the measure for the perceived level of decorrelation.

7. The apparatus according to claim 6, wherein the decorrelator is configured to generate the first decorrelated signal based on a reverberation of the audio signal with a first reverberation time wherein the controller is configured to generate the test decorrelated signal based on a reverberation of the audio signal with a second reverberation time, wherein the second reverberation time is shorter than the first reverberation time.

8. The apparatus according to claim 1, wherein the controller is configured to control the weighting factors such that the weighting factors each comprise one value of a first multitude of possible values the first multitude comprising at least three values comprising a minimum value, a maximum value and a value between the minimum value and the maximum value; and wherein the signal processor is configured to determine spectral weights for a second multitude of frequency bands each representing a portion of the audio signal in the frequency domain, wherein the spectral weights each comprise one value of a third multitude of possible values, the third multitude comprising at least three values comprising a minimum value, a maximum value and a value between the minimum value and the maximum value.

9. The apparatus according to claim 1, wherein the signal processor is configured to:

process the audio signal such that the audio signal is transferred into the frequency domain and such that a second multitude of frequency bands represents the second multitude of portions of the audio signal in the frequency domain;

to determine for each frequency band a first spectral weight representing a processing value for transient processing of the audio signal;

to determine for each frequency band a second spectral weight representing a processing value for tonal processing of the audio signal; and to apply for each frequency band at least one of the first spectral weight and the second spectral weight to spectral values of the audio signal in the frequency band;

wherein the first spectral weights and the second spectral weights each comprise one value of a third multitude of possible values, the third multitude comprising at least three values comprising a minimum value, a maximum value and a value between the minimum value and the maximum value.

10. The apparatus according to claim 9, wherein for each of the second multitude of frequency bands the signal processor is configured to compare the first spectral weight and the second spectral weight determined for the frequency band, to determine, if one of the two values comprises a smaller value and to apply the spectral weight comprising the smaller value to the spectral values of the audio signal in the frequency band.

11. The apparatus according to claim 1, wherein the decorrelator comprises a first decorrelating filter configured to filter the processed audio signal to acquire the first decorrelated signal and a second decorrelation filter configured to filter the processed audio signal to acquire a second decorrelated signal, wherein the combiner is configured for weightedly combining the first decorrelated signal, the second decorrelated signal and the audio signal or the signal derived from the audio signal to acquire the two-channel audio signal.

12. The apparatus according to claim 1, wherein for a second plurality of frequency bands, each of the frequency bands comprising a portion the audio signal represented in the frequency domain and with a first time period the controller is configured to control the weighting factors such that the weighting factors each comprise one value of a first multitude of possible values the first multitude comprising at least three values comprising a minimum value, a maximum value and a value between the minimum value and the maximum value and to adapt the weighting factors determined for an actual time period if a ratio or a difference based on a value of the weighting factors determined for the actual time period and a value of the weighting factors determined for a previous time period is larger than or equal than a threshold value such that a value of the ratio or the difference is reduced; and the signal processor is configured to determine the spectral weights each comprising one value of a third multitude of possible values, the third multitude comprising at least three values comprising a minimum value, a maximum value and a value between the minimum value and the maximum value.

13. A sound enhancing system comprising:

an apparatus for enhancing an audio signal according to claim 1;

a signal input configured to receive the audio signal;

at least two loudspeakers configured to receive the two-channel audio signal or a signal derived from the two-channel audio signal and to generate acoustic signals from the two-channel audio signal or the signal derived from the two-channel audio signal.

14. A method for enhancing an audio signal, comprising:

processing the audio signal in order to reduce or eliminate transient and tonal portions of the processed signal;

generating a first decorrelated signal and a second decorrelated signal from the processed signal;

weightedly combining the first decorrelated signal, the second decorrelated signal and the audio signal or a signal derived from the audio signal by coherence enhancement using time variant weighting factors and to acquire a two-channel audio signal; and controlling the time variant weighting factors by analyzing the audio signal so that different portions of the audio signal are multiplied by different weighting factors and the two-channel audio signal comprises a time variant degree of decorrelation.

15. A non-transitory digital storage medium having a computer program stored thereon to perform the method of for enhancing an audio signal, comprising:

processing the audio signal in order to reduce or eliminate transient and tonal portions of the processed signal;

generating a first decorrelated signal and a second decorrelated signal from the processed signal;

weightedly combining the first decorrelated signal, the second decorrelated signal and the audio signal or a signal derived from the audio signal by coherence enhancement using time variant weighting factors and to acquire a two-channel audio signal; and controlling the time variant weighting factors by analyzing the audio signal so that different portions of the audio signal are multiplied by different weighting factors and the two-channel audio signal comprises a time variant degree of decorrelation, when said computer program is run by a computer.

* * * * *